US012486064B2

(12) United States Patent
Palacios Hernandez

(10) Patent No.: US 12,486,064 B2
(45) Date of Patent: Dec. 2, 2025

(54) PACKAGING SYSTEM

(71) Applicant: WestRock Packaging Systems, LLC, Atlantia, GA (US)

(72) Inventor: Juan Carlos Palacios Hernandez, Atlanta, GA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 142 days.

(21) Appl. No.: 18/465,119

(22) Filed: Sep. 11, 2023

(65) Prior Publication Data

US 2023/0415940 A1 Dec. 28, 2023

Related U.S. Application Data

(63) Continuation-in-part of application No. PCT/US2022/052905, filed on Dec. 14, 2022.

(60) Provisional application No. 63/289,191, filed on Dec. 14, 2021.

(51) Int. Cl.

| | |
|---|---|
| ***B65B 13/00*** | (2006.01) |
| ***B65B 13/02*** | (2006.01) |
| ***B65B 13/18*** | (2006.01) |
| ***B65B 17/02*** | (2006.01) |
| ***B65B 43/44*** | (2006.01) |

(Continued)

(52) U.S. Cl.

CPC ..... *B65B 43/46* (2013.01); *B65B 13/02* (2013.01); *B65B 13/185* (2013.01); *B65B 17/025* (2013.01); *B65B 43/44* (2013.01); *B65D 71/44* (2013.01)

(58) Field of Classification Search

CPC ..... B65B 43/46; B65B 13/02; B65B 13/185; B65B 17/025; B65B 43/44; B65B 35/30; B65B 21/24; B65B 27/04; B65B 17/02

USPC ..... 53/582

See application file for complete search history.

(56) References Cited

U.S. PATENT DOCUMENTS 3,760,554 A * 9/1973 Arneson ..... B65B 17/025 53/49
4,621,734 A * 11/1986 Heijnen ..... B65D 71/46 206/427
10,301,051 B2 * 5/2019 Shaver ..... B29C 65/7841

FOREIGN PATENT DOCUMENTS

EP 0031992 A1 * 7/1981 ..... B65B 17/025
EP 2085314 A2 8/2009

(Continued)

OTHER PUBLICATIONS

PCTUS2252905 International Search Report dated May 22, 2023, 3 pages.

*Primary Examiner* — Jacob A Smith
(74) *Attorney, Agent, or Firm* — Brian J. Goldberg; Tsugihiko Suzuki; Rohini K. Garg

(57) ABSTRACT

Aspects of the disclosure relate to a packaging system, method of packaging, apparatus, handle structure, an article carrier for packaging a plurality of articles, and to a blank for forming the handle structure or article carrier. The packaging system provides an apparatus for applying the handle structure or article carrier to one or more articles. The apparatus provides a component adapted to engage the blank and form the handle structure or article carrier so as to displace a first side of the handle structure or article carrier, disposed on a first side of an article retention structure to a greater extent (Continued)

than a second side of the handle structure or article carrier, disposed on a second, opposing, side of an article retention structure.

11 Claims, 26 Drawing Sheets

(51) Int. Cl.
*B65B 43/46* (2006.01)
*B65D 71/44* (2006.01)

(56) References Cited

FOREIGN PATENT DOCUMENTS

| | | | |
|---|---|---|---|
| EP | 3 738 895 | A1 | 11/2020 |
| WO | 20200210562 | A1 | 10/2020 |

* cited by examiner

PACKAGING SYSTEM

CROSS-REFERENCE TO RELATED APPLICATIONS

This application claims priority to and the benefit of U.S. Provisional Application No. 63/289,191, filed Dec. 14, 2021, and PCT Application No. PCT/US2022/52905, filed Dec. 14, 2022, the entire contents of each are herein incorporated by reference in their entirety.

TECHNICAL FIELD

The present invention relates to a packaging system, to an apparatus, to a method for forming handle structures, to article carriers and to blanks for forming the same. More specifically, but not exclusively, the invention relates to an apparatus for applying a carrier of the top gripping style to one, two or more articles to provide a carrying handle for transportation of the articles.

BACKGROUND

In the field of packaging, it is known to provide article carriers or cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is an object of the present invention to provide a carrier having a carrying handle to enable two or more articles to be transported; in particular for large, or heavy articles.

It is another object of the present invention to provide a system and apparatus for automatically applying a carrier to at least one article.

The present invention seeks to provide an improvement in the field of packaging apparatus and cartons, typically formed from paperboard or the like.

SUMMARY

An aspect of the invention provides a component for an applicator device comprising a first abutment projection having a first end and a second, opposing, end disposed a first distance from the first end. The first end provides a first abutment surface. The applicator device comprises second abutment projection having a first end and a second, opposing, end disposed a second distance from the first end. The first end provides a second abutment surface. The first abutment projection is spaced apart from the second abutment projection by an article receiving orifice. The second distance is less than the first distance. The component further comprises at least one third abutment projection having a first end and a second, opposing, end disposed a third distance from the first end. The first end provides a third abutment surface and wherein the first and second distance are less than the third distance.

Optionally, the component further comprises a pair of third abutment projections.

Optionally, the component further comprises at least one suction cup for engaging an article.

Optionally, the component comprises at least a pair of suction cups, and wherein one of the pair of third abutment projections is disposed between the pair of suction cups.

Optionally, the another one of the pair of third abutment projections is disposed adjacent to the first and second abutment projection, such that the first and second abutment projections and said another third abutment projection at least partially surround the article receiving orifice.

Another aspect of the invention provides an apparatus for forming a package. The apparatus includes an applicator comprising an applicator plate for engaging an article carrier. The applicator plate has a first article receiving orifice and a component mounted thereto at least partially about the first article receiving orifice. The component comprises a first abutment projection having a first end and a second, opposing, end disposed a first distance from the first end. The first end provides a first abutment surface. The component comprises a second abutment projection having a first end and a second, opposing, end disposed a second distance from the first end. The first end provides a second abutment surface. The first abutment projection is spaced apart from the second abutment projection by the first article receiving orifice. The second distance is less than the first distance. The component further comprises at least one third abutment projection having a first end and a second, opposing, end disposed a third distance from the first end. The first end provides a third abutment surface and wherein the first and second distance are less than the third distance.

Optionally, the applicator plate has a second article receiving orifice and a component mounted thereto at least partially about the second article receiving orifice, the component comprising a first abutment projection having a first end and a second, opposing, end disposed a first distance from the first end, the first end providing a first abutment surface, and a second abutment projection having a first end and a second, opposing, end disposed a second distance from the first end, the first end providing a second abutment surface, wherein the first abutment projection is spaced apart from the second abutment projection by the second article receiving orifice, and wherein the second distance is less than the first distance, the component further comprising at least one third abutment projection having a first end and a second, opposing, end disposed a third distance from the first end, the first end providing a third abutment surface and wherein the first and second distance are less than the third distance.

Optionally, the applicator plate comprises a pair of suction cups mounted thereto.

Optionally, the applicator plate comprises a further third abutment projection mounted to the applicator plate between the pair of suction cups.

A further aspect of the invention provides an apparatus for forming a package. The apparatus includes an applicator comprising an applicator plate for engaging an article carrier. The applicator plate has a first article receiving orifice and a major abutment projection having a first end and a second, opposing, end disposed a first distance from the first end. The first end provides a first abutment surface. The applicator plate has a minor abutment projection having a first end and a second, opposing, end disposed a second distance from the first end. The first end provides a second abutment surface. The major abutment projection is spaced apart from the minor abutment projection by the first article receiving orifice. The second distance is less than the first distance. The applicator plate further comprises at least one support abutment projection having a first end and a second, opposing, end disposed a third distance from the first end.

The first end provides a third abutment surface and wherein the first and second distance are less than the third distance.

Optionally, the applicator plate has a second article receiving orifice and a second major abutment projection having a first end and a second, opposing, end disposed a first distance from the first end, the first end providing a second first abutment surface, and a second minor abutment projection having a first end and a second, opposing, end disposed a second distance from the first end, the first end providing a second abutment surface, wherein the second major abutment projection is spaced apart from the second minor abutment projection by the second article receiving orifice, and wherein the second distance is less than the first distance, the applicator plate further comprising at least one second support abutment projection having a first end and a second, opposing, end disposed a third distance from the first end, the first end providing a third abutment surface and wherein the first and second distance are less than the third distance.

Still another aspect of the invention provides a packaging machine for application of a blank to a pair of articles. The packaging machine comprises a conveyor for conveying articles to an application station. The application station has a hopper for supplying blanks. The hopper comprises at least one first pair of posts for supporting a stack of blanks. The blanks comprise a pair of apertures, each aperture receiving one of the first pair of posts. The application station comprises a transfer apparatus for engaging a blank from the hopper and forming a carrier from the blank. The transfer apparatus is mounted to an overhead conveyor, the transfer apparatus includes an applicator comprising an applicator plate for engaging an article carrier. The applicator plate has a first article receiving orifice and a second article receiving orifice each arranged to accommodate one of the first pair of posts and at least one suction cup for engaging the uppermost blank in the stack of blanks.

Optionally, the hopper comprises at least one second pair of posts for supporting a second stack of blanks, the blanks comprising a pair of apertures, each aperture receiving one of the second pair of posts, and wherein the at least one second pair of posts and the at least one first pair of posts are mounted to a turntable such that each of the first and second pairs of posts are rotatable between an operative position in which blanks are removed from the stack and a dormant position in which blanks are held pending rotation into the operative position.

Optionally, the hopper comprises a first group of posts comprising three pairs of posts.

Optionally, the hopper comprises a second group of posts comprising three pairs of posts, each of the first and second groups of posts being rotatable between the operative position and the dormant position.

Yet another aspect of the invention provides a packaging machine for application of a blank to a pair of articles. The packaging machine comprises a conveyor for conveying article to an application station. The conveyor comprises a pair of guide rails between which packages are conveyed. At least one of the guide rails is movable such that the space between the pair of guide rails is adjustable. The at least one guide rail is coupled to the conveyor by an adjustment device. The adjustment device comprises a rail mounted to the conveyor and a pair of carriages mounted to the rail, the carriages are slidable with respect to each other. The adjustment device comprises a first arm pivotally mounted at a first end to the at least one guide rail and pivotally mounted at a second end to a first one of the pair of carriages and a second arm pivotally mounted at a first end to the first arm between the first and second ends of the first arm, and pivotally at a second end to a second one of the pair of carriages.

An aspect of the invention provides a method of packaging at least one article comprising;

- applying an article carrier to at least one article with an applicator comprising:
  - displacing a first side of a primary panel from a planar condition by a first distance;
  - displacing a second opposing side of a primary panel from the planar condition by a second distance, wherein the second distance is less than the first distance;
- engaging the article carrier with at least one article;
- receiving the at least one article in an opening in the primary panel.

Another aspect of the invention provides a method of packaging at least one article comprising:

- engaging an article carrier with an applicator;
- bringing a first limb of the applicator into contact with a first side of a primary panel of the article carrier and applying a force to the first side of a primary panel of the article carrier, adjacent to an article retention structure comprising an opening for receiving the at least one article, so as to displace the first side of a primary panel from a planar condition by a first distance;
- bringing a second limb of the applicator into contact with a second, opposing, side of a primary panel of the article carrier and applying a force to the second side of a primary panel of the article carrier, adjacent to an article retention structure comprising an opening for receiving the at least one article, so as to displace the second side of a primary panel from a planar condition by a second distance, wherein the second distance is less than the first distance.
- bringing the article carrier into contact with at least one article;
- receiving the at least one article in the opening in the primary panel.

Optionally, the method of packaging further comprises folding one or more engaging teeth outwardly of the primary panel to engage a flange of the at least one article.

Optionally, the one or more engaging teeth are disposed about an end edge of the opening adjacent to the first and second sides.

Optionally, the one or more engaging teeth are folded between a pair of spaced apart limbs each of which is in contact with one of the first and second sides of the primary panel.

A further aspect of the invention provides a method of packaging at least one article comprising;

- bringing an article carrier into contact with at least one article;
- applying a force to a first side of a primary panel of the article carrier, adjacent to an article retention structure comprising an opening for receiving the at least one article;
- receiving a first side of the at least one article in the opening adjacent to the first side of the primary panel;
- applying a force to a second, opposing, side of the primary panel of the article carrier, adjacent to an article retention structure comprising an opening for receiving the at least one article;
- receiving a second, opposing, side of the at least one article in the opening adjacent to the second side of the primary panel.

Optionally, the method of packaging further comprises folding one or more engaging teeth outwardly of the primary panel to engage a flange of the at least one article.

Optionally, the one or more engaging teeth are disposed about an end edge of the opening adjacent to the first and second sides.

Optionally, the one or more engaging teeth are folded between a pair of spaced apart limbs each of which is in contact with one of the first and second sides of the primary panel.

Still another aspect of the invention provides a component for an applicator device. The component comprises a first limb having a first end and a second, opposing, end disposed a first distance from the first end. The first end provides a first abutment surface. The component comprises a second limb having a first end and a second, opposing, end disposed a second distance from the first end. The first end provides a second abutment surface. The first limb is spaced apart from the second limb and the second distance is less than the first distance.

Yet another aspect of the invention provides an apparatus for forming a package. The apparatus includes an applicator comprising an applicator plate for engaging an article carrier. The applicator plate has a component mounted thereto that comprises a first limb having a first end and a second, opposing, end disposed a first distance from the first end. The first end provides a first abutment surface. The component comprises a second limb having a first end and a second, opposing, end disposed a second distance from the first end. The first end provides a second abutment surface. The first limb is spaced apart from the second limb and the second distance is less than the first distance.

Still yet another aspect of the invention provides a bushing for mounting in an opening of an applicator device. The bushing comprises an annular wall having opposed ends. A first end provides a pair of spaced apart abutment regions diametrically opposed to each other. A first one of the abutment regions is disposed a first distance from the second end of the annular wall. The second end of the annular wall opposes the first end. A second one of the abutment regions is disposed a second distance from the second end of the annular wall. The second distance is less than the first distance.

An aspect of the invention provides an apparatus for forming a package. The apparatus comprises an applicator including an applicator plate for engaging an article carrier. The applicator plate has at least one aperture and a bushing mounted in the at least one aperture. The bushing comprises an annular wall having opposed ends. A first end provides a pair of spaced apart abutment regions diametrically opposed to each other. A first one of the abutment regions is disposed a first distance from the second end of the annular wall. The second end of the annular wall opposes the first end. A second one of the abutment regions is disposed a second distance from the second end of the annular wall. The second distance is less than the first distance.

Optionally, the bushing comprises a saddle disposed between the pair of abutment regions comprising a recess defining at least in part void for receiving a portion of an article carrier.

Optionally, the apparatus further comprises an engagement device for holding at least one article carrier in engagement with the applicator plate.

Optionally, the engagement device comprises a vacuum system.

Optionally, the saddle is defined by portions of the annular wall disposed between the pair of abutment regions and wherein said portions of the of the annular wall are chamfered.

Optionally, the saddle is defined by portions of the annular wall disposed between the pair of abutment regions and wherein said portions of the of the annular wall are filleted.

Optionally, the saddle is defined by portions of the annular wall disposed between the pair of abutment regions and wherein said portions of the of the annular wall are inclined with respect to surfaces of the pair of abutment regions.

An aspect of the invention provides an article carrier for packaging a plurality of articles. The article carrier comprises at least one primary panel forming a handle structure. The at least one primary panel comprises a handle portion and at least one article retention structure for engaging an article so as to provide a top gripping article carrier. The at least one article retention structure comprises a receiving opening having a boundary including a first edge and second opposing edge. The second edge is defined by a series of distal ends of the engaging teeth providing engaging edges thereof. The first edge is arranged to be closer to the handle portion than the second edge. The first edge is curved such that the centre of curvature of the first edge is located closer to the second edge than to the first edge. The boundary further includes a pair of third and fourth opposing edges which continuously connect the first and second edges such that each of the third and fourth edges provides a smooth transition between the first and second edges.

Optionally, the radius of curvature of the first edge is less than the radius of curvature of the second edge.

Optionally, the article carrier comprises a release device, the release device may comprise a pull tab.

Optionally, the release device comprises a cut disposed between the pull tab and the receiving opening of the at least one article retention structure.

Optionally, the release device comprises a cut disposed on an outer side of the top-receiving opening.

Optionally, the cut is arcuate.

Optionally, the article carrier comprises a relief device, the relief device includes a relief cut, the relief cut being arcuate, the relief cut is disposed between the handle portion and the receiving opening of the at least one article retention structure.

Optionally, the relief cut is disposed on an inner side of the receiving opening, the inner side of the receiving opening opposes the outer side.

Optionally, the article carrier is formed from at least two layers of sheet material in face contacting arrangement, the at least two layers of sheet material includes a first layer and a second layer, the first layer is greater in a longitudinal dimension than the second layer to provide an accessing tab at an end of the first layer projecting outwards beyond the adjacent end of the second layer.

Another aspect of the invention provides an article carrier for packaging a plurality of articles. The article carrier comprises at least one primary panel forming a handle structure. The at least one primary panel comprises a handle portion and at least one article retention structure for engaging an article so as to provide a top gripping article carrier. The at least one article retention structure comprises a top-receiving opening. The article carrier comprises a release device including a pull tab and cut. The cut is disposed between the pull tab and the top-receiving opening of the at least one article retention structure.

Optionally, the cut is disposed on an outer side of the top-receiving opening.

Optionally, the cut is curvilinear.

Yet another aspect of the invention provides an article carrier for packaging a plurality of articles. The article carrier comprises at least one primary panel forming a handle structure. The at least one primary panel comprises a handle portion and at least one article retention structure for engaging an article so as to provide a top gripping article carrier. The at least one article retention structure comprises a top-receiving opening. The article carrier comprises a relief device, the relief device comprising a relief cut. The relief cut is disposed between the handle portion and the top-receiving opening of the at least one article retention structure.

Optionally, the relief cut is disposed on an inner side of the top-receiving opening.

Optionally, the relief cut is curved.

Still yet another aspect of the invention provides an article carrier for packaging a plurality of articles. The article carrier comprises at least one primary panel and a top engaging feature, including a top-receiving opening, in the at least one primary panel. The top engaging feature comprises a series of engaging tabs disposed along an outer section of the perimeter of the top-receiving opening. The outer section generally opposes an inner section adjacent to the handle portion of the at least one primary panel. The radius of curvature of the inner section of the top-receiving opening perimeter is less than the radius of the curvature of the outer section defined by distal ends of the engaging tabs. The distal ends of the engaging tabs provide engaging edges for engaging with an article.

A further aspect of the invention provides a top engaging article carrier for packaging a plurality of articles. The article carrier comprises a pair of engaging portions and a handle portion bridging between the engaging portions. The article carrier is formed from at least two layers of sheet material in face contacting arrangement. The at least two layers of sheet material includes a first layer and a second layer. The first layer is greater in a longitudinal dimension than the second layer to provide an accessing tab at an end of the first layer projecting outwards beyond the adjacent end of the second layer.

Optionally, the at least two layers of sheet material are secured together.

Optionally, the at least two layers of sheet material are secured together by glue or other adhesive treatment.

Optionally, the at least two layers of sheet material are secured together by mechanical fasteners.

Optionally, the mechanical fasteners are provided by article retention structures in each of the at least two layers of sheet material and disposed in vertical registry with each other, the at least two layers of sheet material being secured together when an article is received in the article retention structure in each of the at least two layers of sheet material.

Yet a further aspect of the invention provides an article carrier comprising a primary panel having top engaging feature including a top-receiving opening and a series of engaging tabs disposed along an outer section of the top-receiving opening perimeter. The series of engaging tabs includes a pair of end tabs at each end of the series. Each of the end tabs is defined in part by a tear stopper.

Optionally, the tear stopper takes the form of cutaway selected from the following group of cutaways: a recess and a "J" shaped cut line.

Still yet a further aspect of the invention provides an article carrier comprising a primary panel having a top engaging feature comprising a top-receiving opening and a series of engaging tabs disposed along an outer section of the opening perimeter. At least one medial tab is adjoined at its proximal end by an accessing feature which may be employed by a user to disengage the top engaging feature from the associated article.

Another aspect of the invention provides an article carrier comprising a primary panel having a top engaging feature comprising a top-receiving opening and a series of engaging tabs. A first one of the series of engaging tabs is hinged to the primary panel by a first fold line. A second one of the series of engaging tabs is hinged to the primary panel by a second fold line. The first and second fold lines define an obtuse angle therebetween.

Optionally, the obtuse angle is in the range 115° to 135°.

Optionally, the obtuse angle about 125°.

Optionally, the first fold line defines an angle of about 20° with respect to a first notional line, the first notional line is parallel to the longitudinal axis of the primary panel.

Optionally, the second fold line defines an angle of about 15° with respect to a second notional line, second notional line is perpendicular to the first notional line.

A further aspect of the invention provides a blank for forming an article carrier. The blank comprises at least one primary panel for forming a handle structure. The at least one primary panel comprises a handle portion and at least one article retention structure for engaging an article so as to provide a top gripping article carrier. The at least one article retention structure comprises a receiving opening having a boundary including a first edge and second opposing edge. The second edge is defined by a series of distal ends of the engaging teeth providing engaging edges thereof. The first edge is arranged to be closer to the handle portion than the second edge. The first edge is curved such that the centre of curvature of the first edge is located closer to the second edge than to the first edge. The boundary further includes a pair of third and fourth opposing edges which continuously connect the first and second edges such that each of the third and fourth edges provides a smooth transition between the first and second edges.

Still another aspect of the invention provides a blank for forming an article carrier, the blank comprises at least one primary panel forming a handle structure. The at least one primary panel comprises a handle portion and at least one article retention structure for engaging an article so as to provide a top gripping article carrier. The at least one article retention structure comprises a top-receiving opening. The blank comprises a release device including a pull tab and cut. The cut is disposed between the pull tab and the top-receiving opening of the at least one article retention structure.

Still a further aspect of the invention provides a blank for forming an article carrier. The blank comprises at least one primary panel forming a handle structure. The at least one primary panel comprises a handle portion and at least one article retention structure for engaging an article so as to provide a top gripping article carrier. The at least one article retention structure comprises a top-receiving opening. The blank comprises a relief device. The relief device comprises a relief cut. The relief cut is disposed between the handle portion and the top-receiving opening of the at least one article retention structure.

Yet still a further aspect of the invention provides a blank for forming an article carrier. The blank comprises at least one primary panel and a top engaging feature, including a top-receiving opening, in the at least one primary panel. The top engaging feature comprises a series of engaging tabs disposed along an outer section of the perimeter of the top-receiving opening. The outer section generally opposes an inner section adjacent to the handle portion of the at least one primary panel. The radius of curvature of the inner section of the top-receiving opening perimeter is less than the radius of the curvature of the outer section defined by distal ends of the engaging tabs. The distal ends of the engaging tabs providing engaging edges for engaging with an article.

Another aspect of the invention provides a blank for forming a top engaging article carrier. The blank comprises at least two panels for providing respective layers of sheet material disposed in face contacting arrangement in a setup carrier. The at least two panels provides a first layer and a second layer. Each of the at least two panels comprises a pair of engaging portions and a handle portion bridging between the engaging portions. The panel providing the first layer is greater in a longitudinal dimension than the panel providing second layer so as to provide an accessing tab at an end of the first layer projecting outwards beyond the adjacent end of the second layer.

Still another aspect of the invention provides a blank for forming an article carrier. The blank comprises a primary panel having a top engaging feature comprising a top-receiving opening and a series of engaging tabs disposed along an outer section of the top-receiving opening perimeter. The series of engaging tabs includes a pair of end tabs at each end of the series. Each of the end tabs is defined in part by a tear stopper.

A further aspect of the invention provides a blank for forming an article carrier. The blank comprises a primary panel having a top engaging feature including a top-receiving opening and a series of engaging tabs disposed along an outer section of the opening perimeter. At least one medial tab is adjoined at its proximal end by an accessing feature which may be employed by a user in a setup carrier to disengage the top engaging feature from the associated article.

Yet still a further aspect of the invention provides a blank for forming an article carrier. The blank comprises a primary panel having a top engaging feature comprising a top-receiving opening and a series of engaging tabs. A first one of the series of engaging tabs is hinged to the primary panel by a first fold line. A second one of the series of engaging tabs is hinged to the primary panel by a second fold line. The first and second fold lines define an obtuse angle therebetween.

Yet further aspect of the invention provides a package. The package comprises at least one article and an article carrier. The article carrier comprises at least one primary panel forming a handle structure. The at least one primary panel comprises a handle portion and at least one article retention structure in engagement with the at least one article. The at least one article retention structure comprises a receiving opening having a boundary including a first edge and second opposing edge. The second edge is defined by a series of distal ends of engaging teeth providing engaging edges which are in engagement with the at least one article below a radially protruding portion of the at least one article. The first edge is arranged to be closer to the handle portion than the second edge. The boundary further includes a pair of third and fourth opposing edges which continuously connect the first and second edges. The third and fourth edges are spaced apart such that the maximum distance therebetween is less than the lateral dimension of the radially protruding portion of the at least one article.

In the package of the above aspect, each of the first, second, third and fourth edges may be curved such that each of the third and fourth edges provides a smooth transition between the first and second edges. Optionally, the first edge may be curved such that the centre of curvature of the first edge is located closer to the second edge than to the first edge. In the same optional arrangement, the radius of curvature of the first edge may be less than the radius of curvature of the second edge. The at least one article may be at least one bottle having a neck flange, the radially protruding portion may be the neck flange of the at least one bottle, and the lateral dimension may be the diameter of the neck flange.

Further features and advantages of the present invention will be apparent from the specific embodiments illustrated in the drawings and discussed below.

Within the scope of this application, it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Embodiments of the invention will now be described with reference to the accompanying drawings, in which.

DETAILED DESCRIPTION OF EMBODIMENTS

Detailed descriptions of specific embodiments of a packaging system, method and apparatus, handle structures, packages, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packaging system, method and apparatus, handle structures, packages, blanks, and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
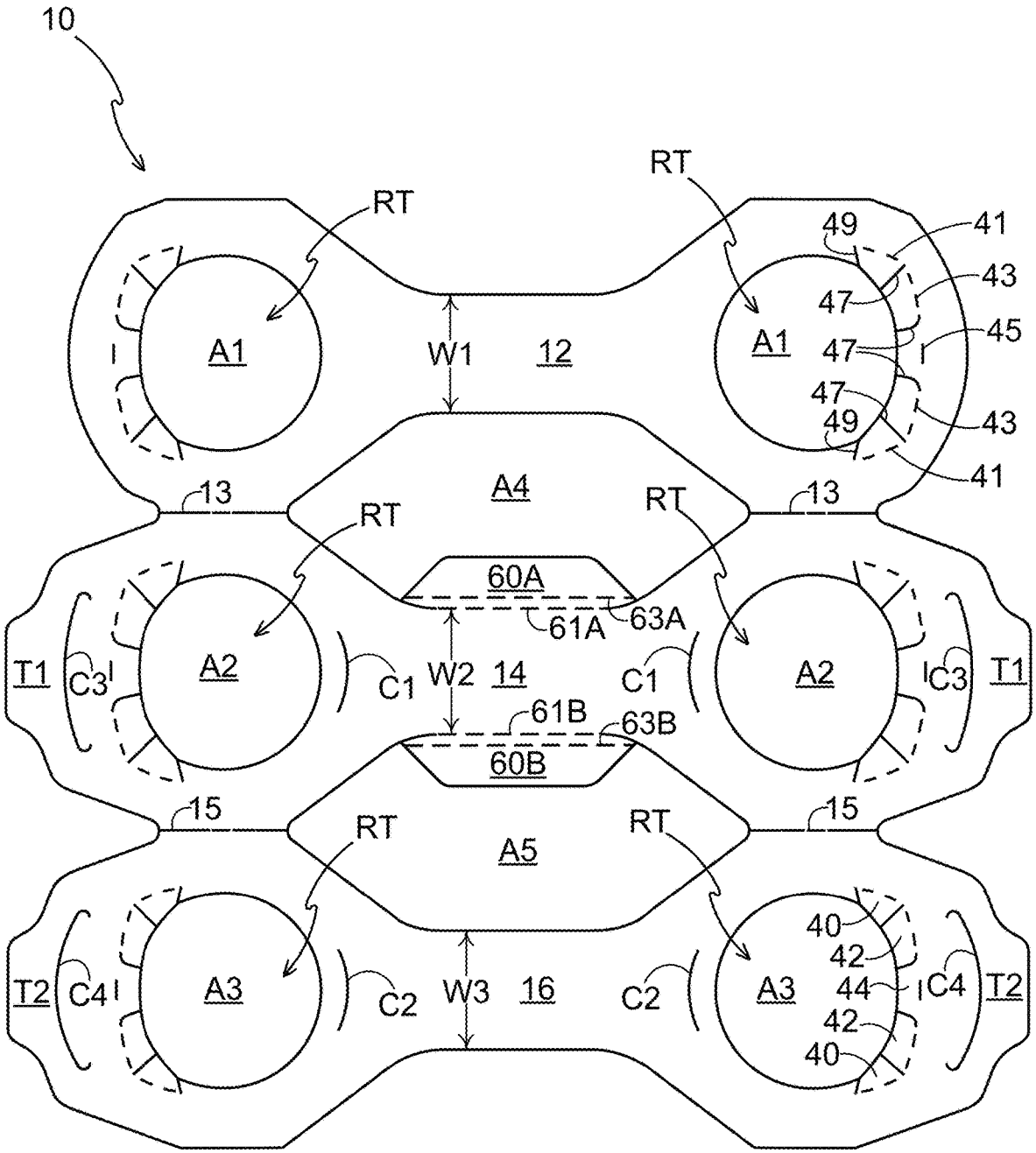
FIG. 1 is a plan view from above of a blank for forming a carrier according to a first example.
Figure 1B:
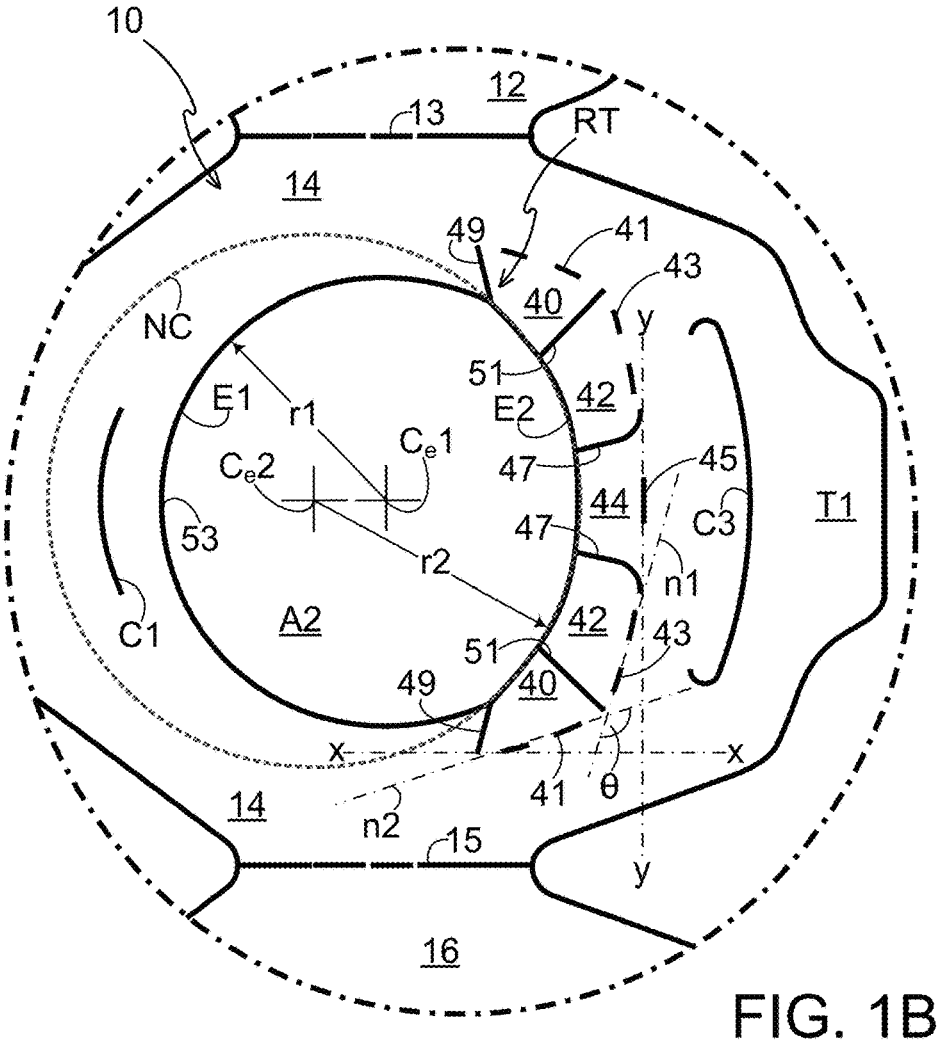
FIG. 1B is an enlarged view of a portion of the blank of FIG. 1.

Referring to FIG. 1, there is shown a plan view of a blank 10 capable of forming a carton or carrier 90, as shown in FIGS. 2 to 5, for carrying a group of primary products such as, but not limited to, bottles, hereinafter referred to as articles. The blank 10 forms a secondary package or handle structure for packaging at least one primary product container or package. Alternative blanks 110, 210, 410, 510, 610, 710 are shown in FIGS. 6 to 11 for forming alternative carriers (not shown).

In the embodiments detailed herein, the terms "carton" and "carrier" refer, for the non-limiting purpose of illustrating the various features of the invention, to a container 90 for engaging and carrying articles, such as primary product containers. It is contemplated that the teachings of the invention can be applied to various product containers, which may or may not be tapered and/or cylindrical. Other exemplary containers include bottles (for example metallic, glass or plastics bottles), cans (for example aluminium cans), tins, pouches, packets and the like.

The blanks 10; 110; 210; 410; 510; 610; 710 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structure or carton 90 described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiment, the blanks 10; 110; 210; 410; 510; 610; 710 are configured to form a carton or carrier 90 for packaging an exemplary arrangement of exemplary articles. In the illustrated embodiments the arrangement is an m×n matrix or array, having one rows (m=1) and two columns (n=2); in the illustrated embodiment one rows of two articles are provided, and the articles are 2.84 L bottles, the bottles may be formed from a suitable material such as, but not limited to, glass, Aluminium or PET (polyester—polyethylene terephthalate). Alternatively, the blanks 10; 110; 210; 410; 510; 610; 710 can be configured to form a carrier for packaging other types, number and size of articles and/or for packaging articles in a different arrangement or configuration for example, but not limited to, fully enclosed cartons or wrap-around carriers, the articles may be cups, pouches, pots or cans.

Turning to FIG. 1, there is illustrated a blank 10 for forming a carton 90 (see FIGS. 2 to 4) according to a first embodiment. The blank 10 comprises a plurality of panels 12, 14, 16 arranged in a linear series hinged one to the next by fold lines 13, 15 respectively.

The plurality of main panels 12, 14, 16 form a top engaging carrier or handle structure. The plurality of panels 12, 14, 16 comprises a first panel 12, a second panel 14, and a third panel 16. The second panel 14 is hingedly connected to the first panel 12 by a hinged connection in the form of a fold line 13. The third panel 16 is hingedly connected to the second panel 14 by a hinged connection in the form of a fold line 15.

The second panel 14 forms an upper or outer panel 14, the third panel 16 forms a lower or inner panel 16 and the first panel 12 forms an intermediate panel 12 disposed between the second panel 14 and the third panel 16.

Each of the main panels 12, 14, 16 may be generally bow-tie shaped, that is to say the main panels 12, 14, 16 comprises a waisted intermediate portion disposed or bridging between opposed flared, widened, or bulbous end portions.

Intermediate portions of each of the main panels 12, 14, 16 provide or define a handle portion.

The intermediate portion of the first panel 12 comprises a first width or lateral dimension W1. The intermediate portion of the second panel 14 comprises a second width or lateral dimension W2. The intermediate portion of the third panel 16 comprises a third width or lateral dimension W3.

The intermediate portion of the first panel 12 is separated from the intermediate portion of the second panel 14 by an aperture A4. The intermediate portion of the second panel 14 is separated from the intermediate portion of the third panel 16 by an aperture A5.

The first and third width dimensions W1, W3 may be equal to or less than the second width dimension W2. The first and third width dimensions W1, W3 may be equal to each other. In some embodiments, the third width dimension W3 may be less than the first width dimension W1.

The second or upper panel 14 may comprise a pair of opposed handle flaps 60A, 60B hinged to opposing side edges of the intermediate portion of the second or upper panel 14 by respective hinged connections in the form of fold lines 61A, 61B.

Each of the handle flaps 60A, 60B may comprise a second fold line 63A, 63B, the second fold lines 63A, 63B may facilitate folding of the handle flaps 60A, 60B about the intermediate and lower panels 12, 16 to be in face-to-face relationship with the lower panel 16.

Each of the main panels 12, 14, 16 comprises at least one at least one article retention structure RT. The main panels 12, 14, 16 comprises a plurality of article retention structures RT, specifically two article retention structures RT arranged in 1×2 matrix or array. Each of the article retention structures RT comprises an opening or aperture A1, A2, A3.

The article retention structures RT comprises a toothed region defined by a plurality of teeth or tabs 40, 42, 44 and a tooth free or toothless region. The toothed region is disposed in closer proximity to end edges of the main panels 12, 14, 16 than the toothless region.

The toothed region comprises five teeth or engaging tabs 40, 42, 44. A central engaging tab 44 lies on a notional line extending longitudinally of the main panel 12, 14, 16 and passing through the centre of the aperture A1, A2, A3. The toothed region comprises a pair of outer engaging tabs 40 defining a boundary between the toothed and toothless regions. The toothed region comprises an intermediate engaging tab 42 disposed between the central engaging tab 44 and a respective one of the outer engaging tabs 40.

The central engaging tab 44 is hinged to the main panel 12, 14, 16 by a hinged connection defined in part by a cut line 45, the hinged connection and/or cut line 45 lie on a notional transverse line y-y.

The intermediate engaging tabs 42 are hinged to the main panel 12, 14, 16 by a hinged connection defined in part by a pair of cut lines 43, the hinged connection and/or cut lines 43 lie on a first notional line n1.

The outer engaging tabs 40 are hinged to the main panel 12, 14, 16 by a hinged connection defined in part by a pair of cut lines 41, the hinged connection and/or cut lines 41 lie on a second notional line n2.

The second notional line n2 is oriented at a non-zero angle with respect to the first notional line n1. The second notional line n2 may be obliquely oriented with respect to the first notional line n1. The second notional line n2 is oriented at an angle θ with respect to the first notional line n1, the angle θ may be obtuse and may be in the range 115° to 135° and optionally may be about 125°.

The hinged connection and/or cut lines 41 may be oriented at an angle of about 20° with respect to a notional longitudinal line x-x. The notional longitudinal line x-x is oriented perpendicularly with respect to the notional transverse line y-y. The notional longitudinal line x-x is parallel with a longitudinal axis of the main panel 12, 14, 16.

The hinged connection and/or cut lines 43 may be oriented at an angle of about 15° with respect to the notional transverse line y-y.

The toothless region may be defined by a cutline 53, cut line 53 may define a portion of a circle having a first centre $C_e$1 and a first radius r1.

The plurality of teeth 40, 42, 44 each comprise a free engaging edge substantially defining a portion of a notional circle NC. The notional circle NC comprises a second centre $C_e$2 and a second radius r2.

The second radius r2 is greater than the first radius r1. The second centre $C_e$2 is offset longitudinally from the first centre $C_e$1. The second centre $C_e$2 is disposed in closer proximity to the intermediate portion than the first centre $C_e$1.

The central engaging tab 44 may be defined, at least in part, by a pair of first cut lines 47. Each of the pair of first cut lines 47, or at least a portion thereof, may lie upon a radial line passing through the second centre $C_e$2 of the notional circle NC. The pair of first cut lines 47 may be substantially "J" shaped.

Figure 8:
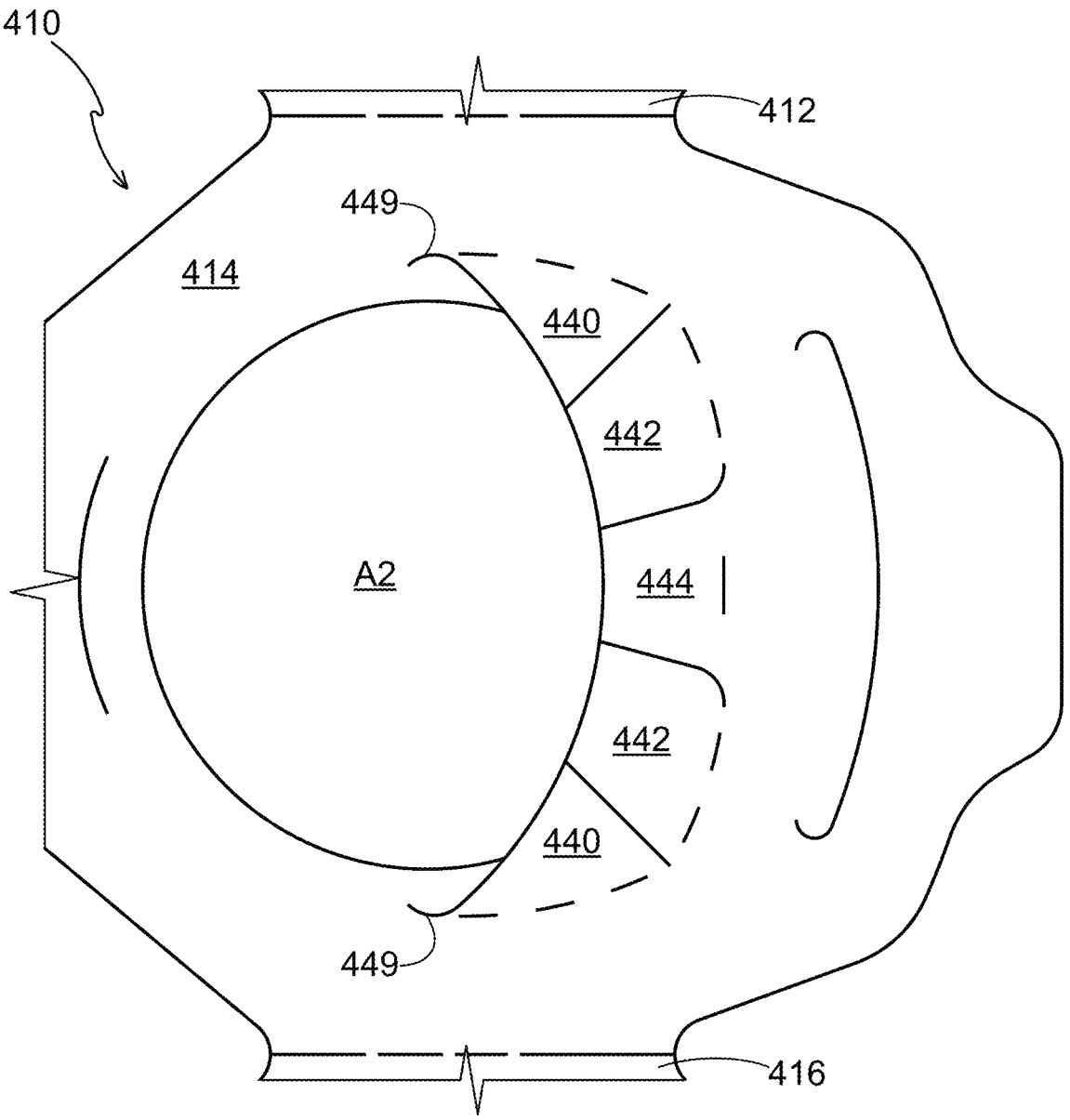
FIG. 8 is an enlarged plan view of a portion of a blank for forming a carrier according to a fourth example.

The outer engaging tabs 40 are defined, at least in part, by a second cut line 51 and a third cut line 49. The second cut line 51 and a third cut line 49 are divergently arranged with respect to each other such that the outer engaging tabs 40 taper or narrow towards their free engaging edge. The third cut line 49 is shorter in length than the second cut line 51. In some embodiments, the third cut line 49 may comprise a tear stopper, the third cut line 49 may terminate with a non-linear portion such as but not limited to a "J" or "C" shaped cutline portion. This is best shown in FIG. 8 wherein the third cut line 449 comprises a tear stopper, wherein the third cut line 449 terminates with a "J" shaped cutline portion. In other embodiments, the tear stopper may take the form of a recess or cutaway providing a transition between the aperture A1, A2, A3 and a respective one of the outer engaging tabs 40.

The second cut line 51 is divergently arranged with respect to a radial line passing through the second centre $C_e$2 of the notional circle NC and the vertex or intersection between the second cut line 51 and the cutline defining the free engaging edges of the plurality of teeth 40, 42, 44.

The third cut line 53 is divergently arranged with respect to a radial line passing through the second centre $C_e$2 of the notional circle NC and the vertex or intersection between the third cut line 53 and the cutline defining the free engaging edges of the plurality of teeth 40, 42, 44.

Figure 10:
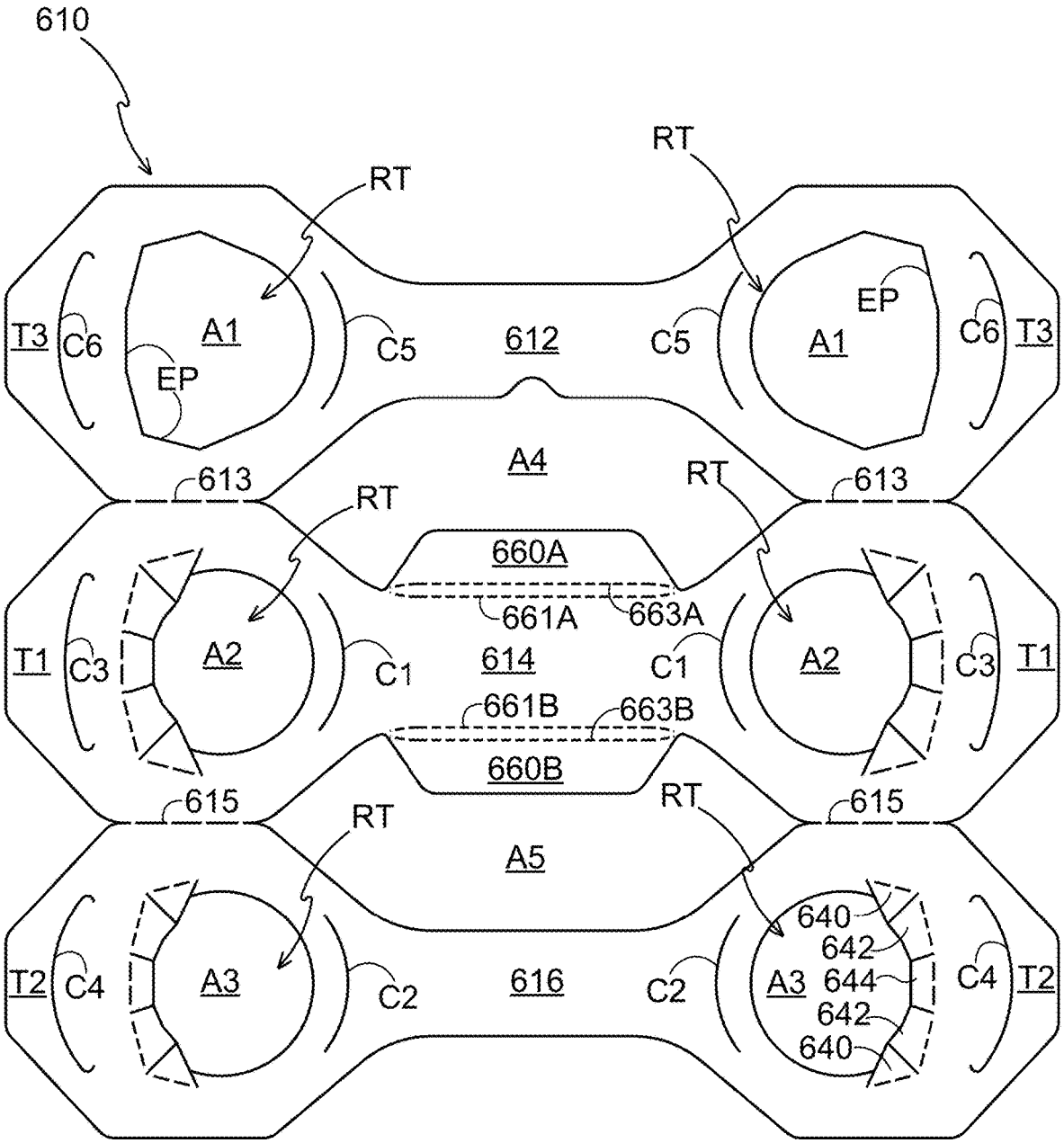
FIG. 10 is a plan view from above of a blank for forming a carrier according to a sixth example.

FIG. 10 shows the blank 10 in a folded condition, the position of the first panel 12 and third panel 16 has been superimposed on the second panel 14. An article retention structure RT in the second or upper panel 14 is in vertical alignment with article retention structures RT in the first and third panels 12, 16. The engaging tabs 40, 42, 44 of the article retention structure RT in the second panel 14 are longer or greater in height than the engaging tabs 40, 42, 44 of the article retention structure RT in the first or intermediate panel 12. The engaging tabs 40, 42, 44 of the article retention structure RT in the first panel 12 are longer or greater in height than the engaging tabs 42, 44 of the article retention structure RT in the third or lower panel 16.

Figure 1C:
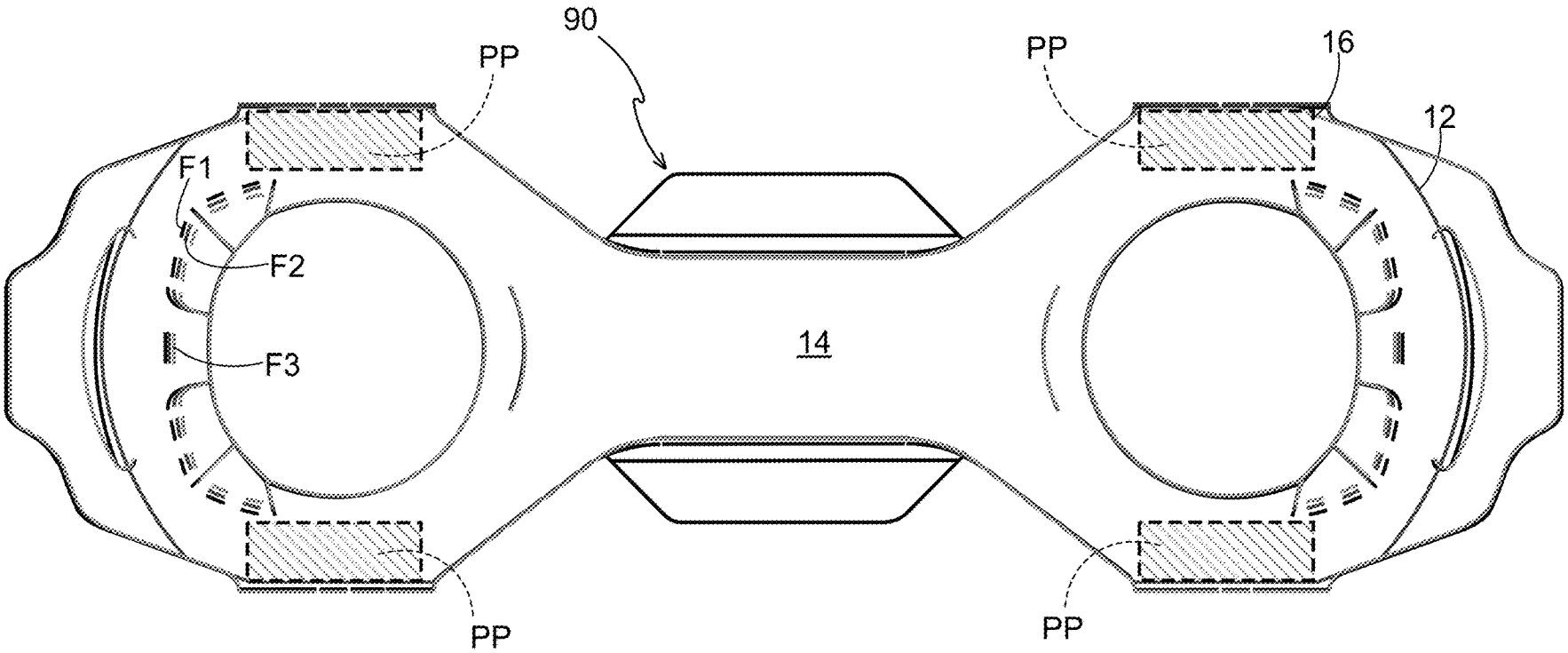
FIG. 1C is a plan view from above of the blank of FIG. 1 in a folded condition showing the position of the panels relative to each other.
Figure 1D:
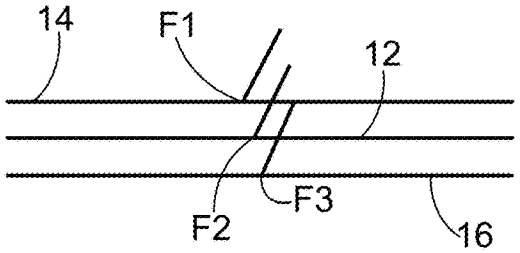
FIG. 1D is a schematic side view of a portion of the carrier showing engagement tabs in an engaging position.

FIG. 1D schematically illustrates the engaging tab 44 of the article retention structure RT in the first, second, and third panels 12, 14, 16 in a folded condition. The set of teeth or tabs 40, 42, 44 in each layer is shorter than set of teeth or tabs 40, 42, 44 in the layer above.

The hinged connections F1 of the set of teeth or tabs 40, 42, 44 in the upper layer 14 is offset with respect to the hinged connections F2 of the set of teeth or tabs 40, 42, 44 in the intermediate layer 12 below. The hinged connections F2 of the set of teeth or tabs 40, 42, 44 in the intermediate layer 12 is offset with respect to the hinged connections F3 of the set of teeth or tabs 40, 42, 44 in the lower layer 16 below.

The offset relationship between the hinged connections or fold line of the tabs 40, 42, 44 in subsequent layers may facilitate easier engagement of the article retention structure RT or carrier 90 with an article B. The first or uppermost layer of tabs 40, 42, 44 engages the article B while the subsequent layers reinforce the first or uppermost layer of tabs 40, 42, 44.

The hinged connections F1 of the engaging tabs 40, 42, 44 of the article retention structure RT in the second or upper panel 14 are offset with respect to the hinged connections F2 of the engaging tabs 40, 42, 44 of the article retention structure RT in the first or intermediate panel 12.

The hinged connections F2 of the engaging tabs 40, 42, 44 of the article retention structure RT in the first or intermediate panel 12 are offset with respect to the hinged connections F3 of the engaging tabs 40, 42, 44 of the article retention structure RT in the third or lower panel 16.

The article retention structures RT in the second panel 14 may comprise a first relief cut C1. The first relief cut C1 may comprise a circumferential cut line about a portion of the toothless region and spaced apart from the cut line 53 defining the toothless region about the aperture A2.

The second panel 14 may comprise at least one first relief cut C1, the second panel 14 may comprise a pair of first relief cuts C1. The second panel 14 may comprise a first relief cut C1 arranged to extend partially about the aperture A2 or each article retention structure RT provided therein.

The first relief cuts C1 may be non-linear in shape and may be arcuate in shape. The first relief cuts C1 are spaced apart from the cut line 53 defining the aperture A2. The first relief cuts C1, when circular in shape, may have a radius of curvature greater than the radius of curvature of the cut line 53, and may be concentrically arranged with respect to the cut line 53.

Each of the first relief cuts C1 may be disposed between the aperture A2 and the intermediate or waisted portion of the second panel 14.

The article retention structures RT in the third panel 16 may comprise a second relief cut C2. The second relief cut C2 may comprise a circumferential cut line about a portion of the toothless region and spaced apart from the cut line 53 defining the toothless region about the aperture A3.

The third panel 16 may comprise at least one second relief cut C2, the third panel 16 may comprise a pair of second relief cuts C2. The third panel 16 may comprise a second relief cut C2 arranged to extend partially about the aperture A3 or each article retention structure RT provided therein.

The second relief cuts C2 may be non-linear in shape and may be arcuate in shape. The second relief cuts C2 are spaced apart from the cut line 53 defining the aperture A3. The second relief cuts C2, when circular in shape, may have a radius of curvature greater than the radius of curvature of the cut line 53, and may be concentrically arranged with respect to the cut line 53.

Each of the second relief cuts C2 may be disposed between the aperture A3 and the intermediate or waisted portion of the third panel 16.

The relief cuts C1, C2 may improve or increase the flexibility of the article carrier 90 when using the handle H to remove the package from a shelf or storage device. The relief cuts C1, C2 may allow the article carrier 90 to flex, deform, or bend whilst preventing or inhibiting disengagement of the article retention structures RT from the article B, particularly the inner or toothless edge E1.

The second panel 14 and/or the third panel 16 may comprise a pull tab T1, T2 at each end thereof. The pull tab T1, T2 may be defined by a tapered tongue portion integral with respective one of the second and third panels 14, 16. The pull tab T1, T2 forms a release feature to enable a consumer or user to release the article B being packaged from the article carrier 90.

Each release feature may comprise a control cut C3, C4 defined in the second panel 14 and/or the third panel 16. A first control cut C3 in the second panel 14 may define, at least in part, a first or upper pull tab T1. A second control cut C4 in the third panel 16 may define, at least in part, a second or lower pull tab T2.

The first control cuts C3 may be non-linear in shaped and may comprise an arcuate cut line terminated at each end with a "C" shaped cut.

The second control cuts C4 may be non-linear in shaped and may comprise an arcuate cut line terminated at each end with a "C" shaped cut. The arcuate cut line of the first control cuts C3 may comprise a larger radius of curvature than the arcuate cut line of the second control cuts C4.

The first and second control cuts C3, C4 may facilitate release of the article carrier 90 from the articles B. The first and second control cuts C3, C4 may direct or distribute pull forces towards the sides or marginal regions of the main panel 14, 16 about the article retention structures RT.

The second panel 12 comprises an end edge which terminates in closer proximity to the article retention structures RT than the first and second control cuts C3, C4. In other embodiments, the second panel 12 may be increased in length and may comprise additional control cuts in the region of the first and second control cuts C3, C4.

Figure 4:
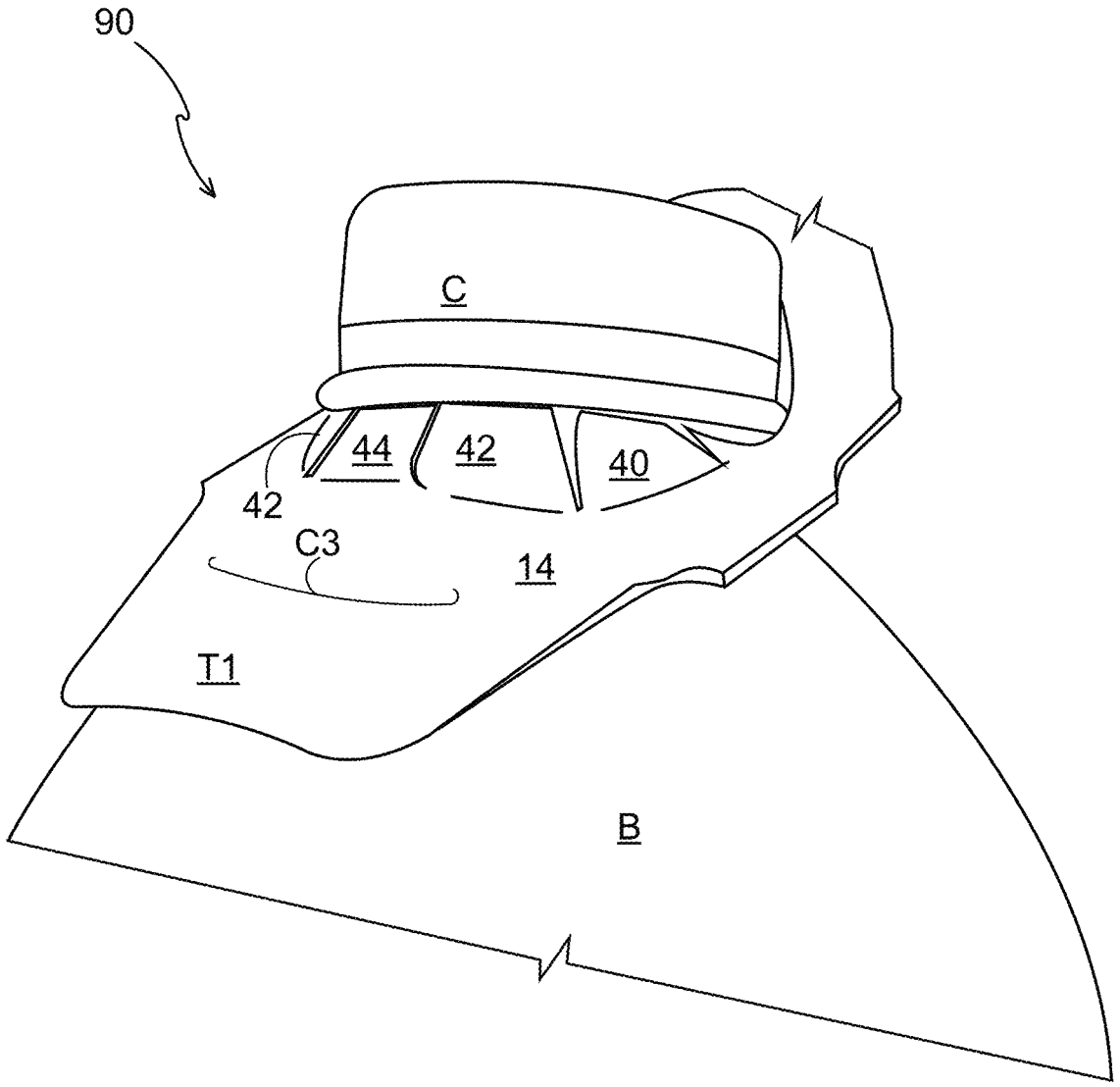
Figure 5:
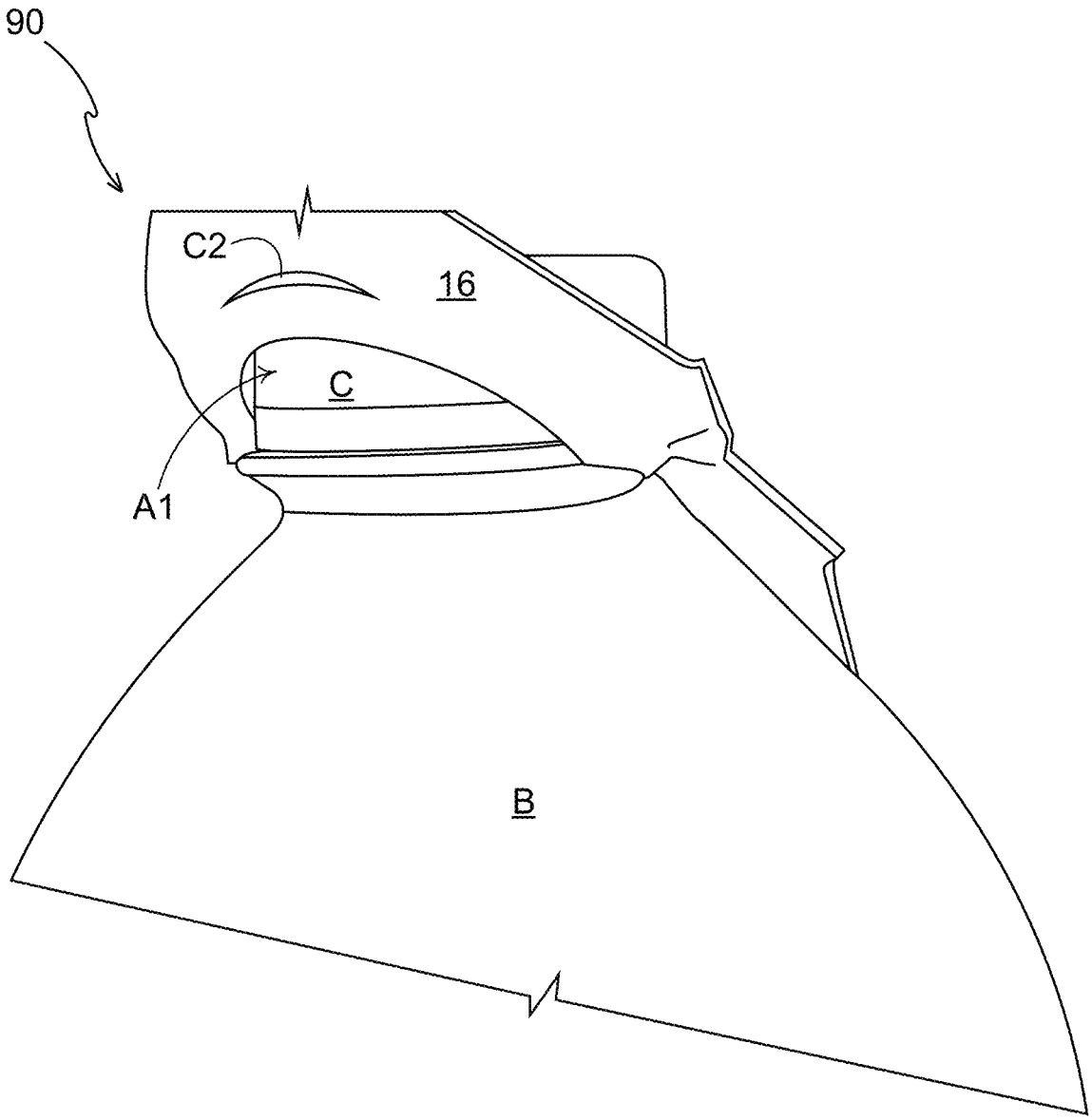

The blank 10 is foldable to form a package 90 as illustrated in FIGS. 4 and 5.

Figure 2:
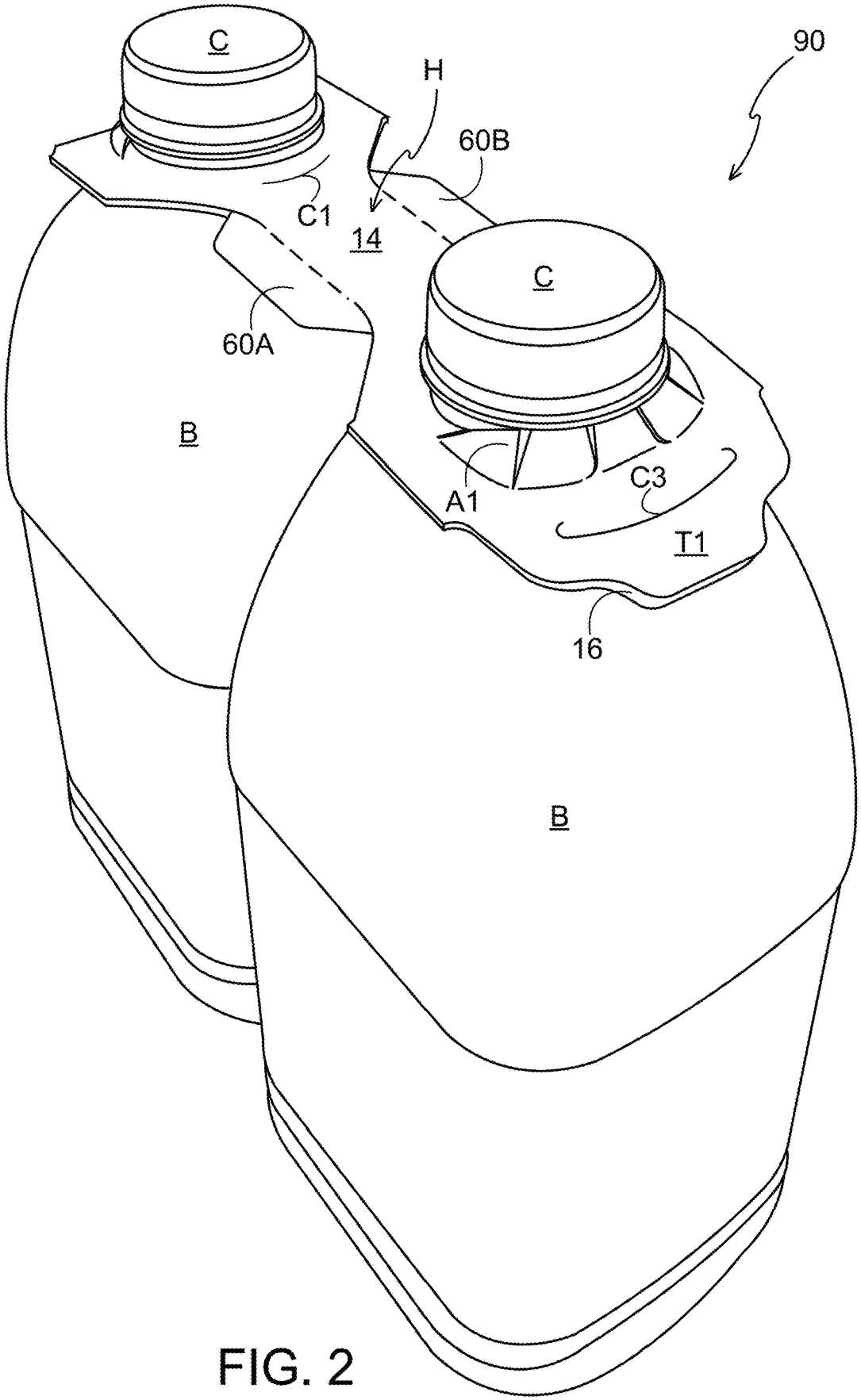
FIG. 2 is a perspective view of a carton formed from the blank of FIG. 1.

Turning to the construction of the article carrier 90 as illustrated in FIGS. 2, the article carrier 90 can be formed by a series of sequential folding operations. The folding process is not limited to that described below and may be altered according to particular manufacturing requirements.

The first panel 12 is folded, with respect to the second panel 14 about fold line 13, to be brought into face contacting relationship therewith.

The third panel 16 is folded, with respect to the second panel 14 about fold line 15, to be brought into face contacting relationship with the first panel 12.

Figure 3:
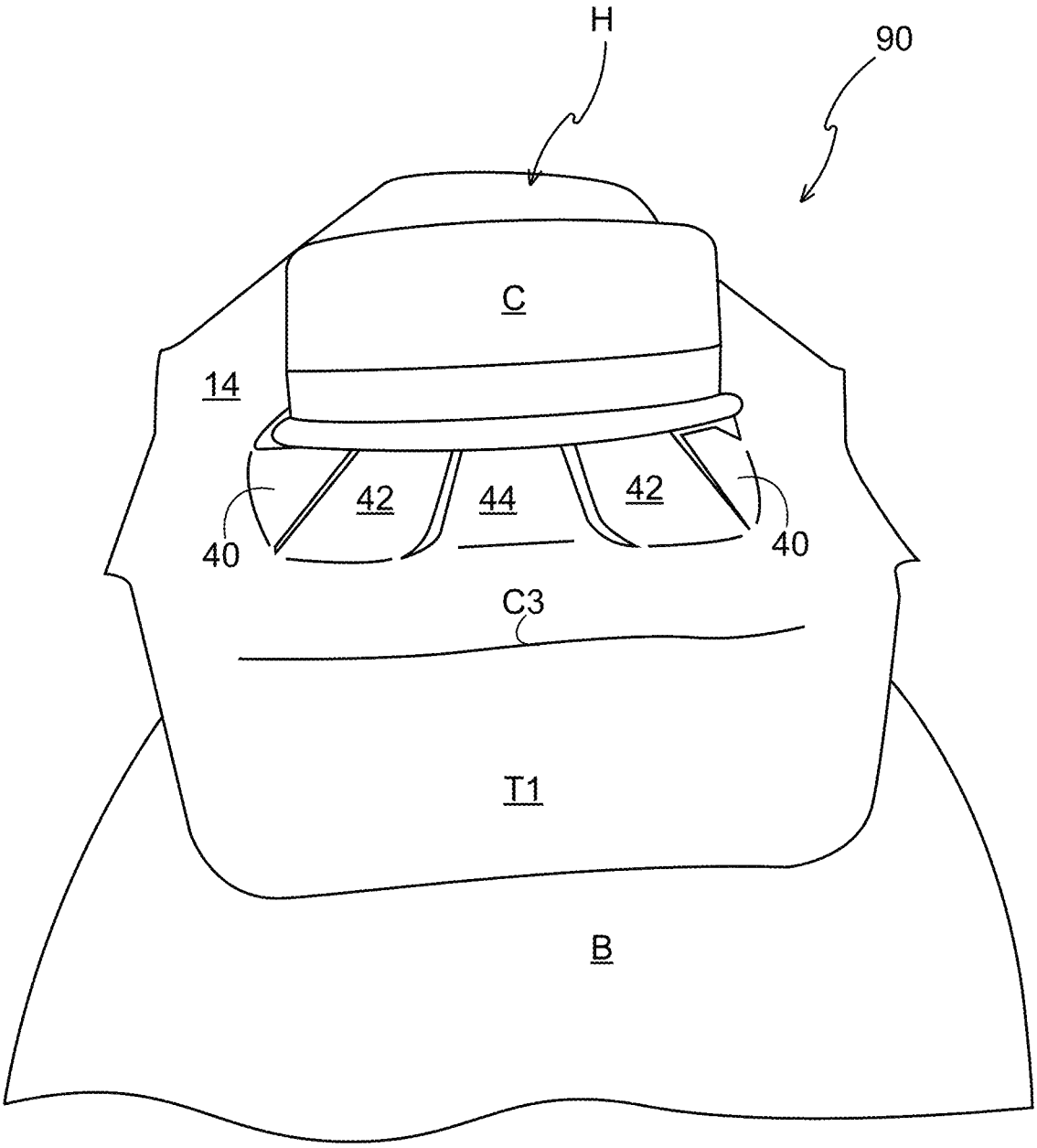
FIGS. 3, 4, and 5 are alternative perspective views of the carton of FIG. 2.

Once the carrier 90 is erected, the carrier 90 may be loaded with a group of articles B; in the embodiment illustrated in FIGS. 2, 3 and 4 two articles B arranged in a 1×2 matrix or array.

The group of articles B may be loaded through the third panel 16, and subsequently through the first and second panels 12, 14. Upper portions of the articles B, the upper portion may include a cap or end closure C, are inserted into the carrier 90, each article retention structure RT receives a portion of a respective article B. The teeth 40, 42, 44 are displaced upwardly. The teeth 40, 42, 44 engage an article below a flange F (see FIGS. 3 and 4), projection, under cut or other suitable feature of the article B or its end closure C.

Referring now to FIGS. 6, 7 and 9 to 11, there are shown additional embodiments of the present disclosure. In the second and third illustrated embodiments like numerals have, where possible, been used to denote like parts, albeit with the addition of the prefix "100", "200", "500", "600", "700" to indicate that these features belong to the second, third, fifth, sixth, and seventh embodiments respectively. The additional embodiments share many common features with the first embodiment and therefore only the differences from the embodiment illustrated in FIGS. 1 to 5 will be described in detail.

Figure 6:
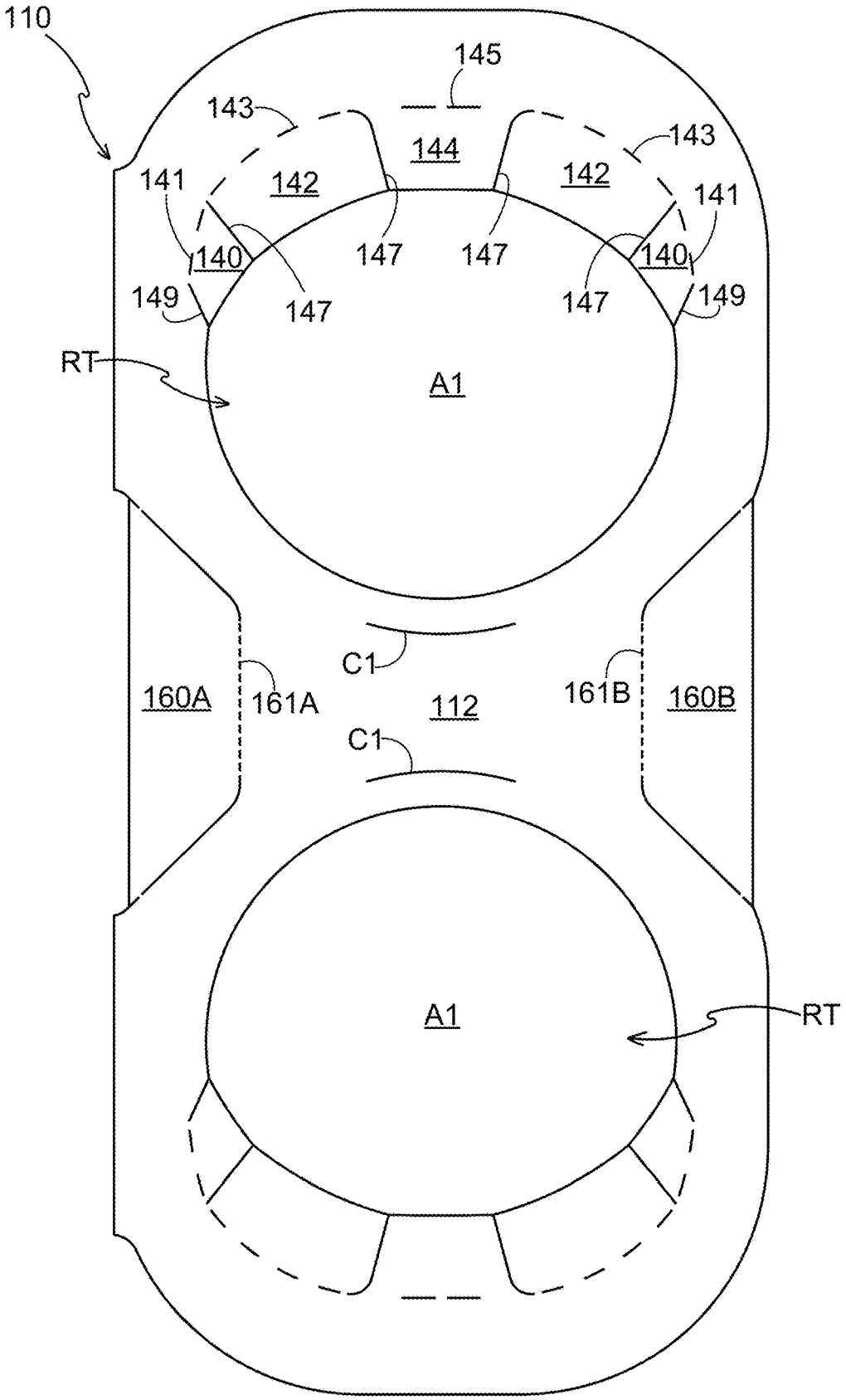
FIG. 6 is a plan view from above of a blank for forming a carrier according to a second example.

Turning to FIG. 6, there is illustrated a blank 110 for forming a carrier (not shown) according to a second embodiment. The blank 110 comprises a main panel 112.

The main panel 112 forms a top engaging carrier or handle structure.

The main panel 112 comprises at least one at least one article retention structure RT. The main panel 112 comprises a plurality of article retention structures RT, specifically two article retention structures RT arranged in 1×2 matrix or array. Each of the article retention structures RT comprises an opening or aperture A1. The article retention structures RT of the embodiment of FIG. 6 are substantially similar in construction to the article retention structures RT of FIG. 1 and will not be described in further detail.

The main panel 112 comprises a pair of opposed handle flaps 160A, 160B hinged to opposing side edges of an intermediate portion of the main panel 112 by respective hinged connections in the form of fold lines 161A, 161B.

The handle flaps 160A, 160B may be substantially trapezoidal in shape.

Each of the handle flaps 160A, 160B defines, at least in part, a recess in a side edge of the main panel 112. When the handle flaps 160A, 160B are in a folded condition the main panel may adopt a generally bow-tied shape. That is to say the main panel 112 comprises a waisted intermediate portion disposed the pair of opposed handle flaps 160A, 160B and the main panel 112 comprises opposed flared, widened, or bulbous end portions in which an article retention structure RT is provided.

The intermediate portion of the main panel 112 provides or defines a handle portion.

In the embodiment illustrated in FIG. 6, the pull tabs T1, T2 of the previous embodiment have been omitted as have the control cuts C3, C4. In alternative embodiments, the main panel 112 may comprise pull tabs and/or control cuts C3, C4 substantially similar to those of described above and/or shown in FIG. 1.

Figure 7:
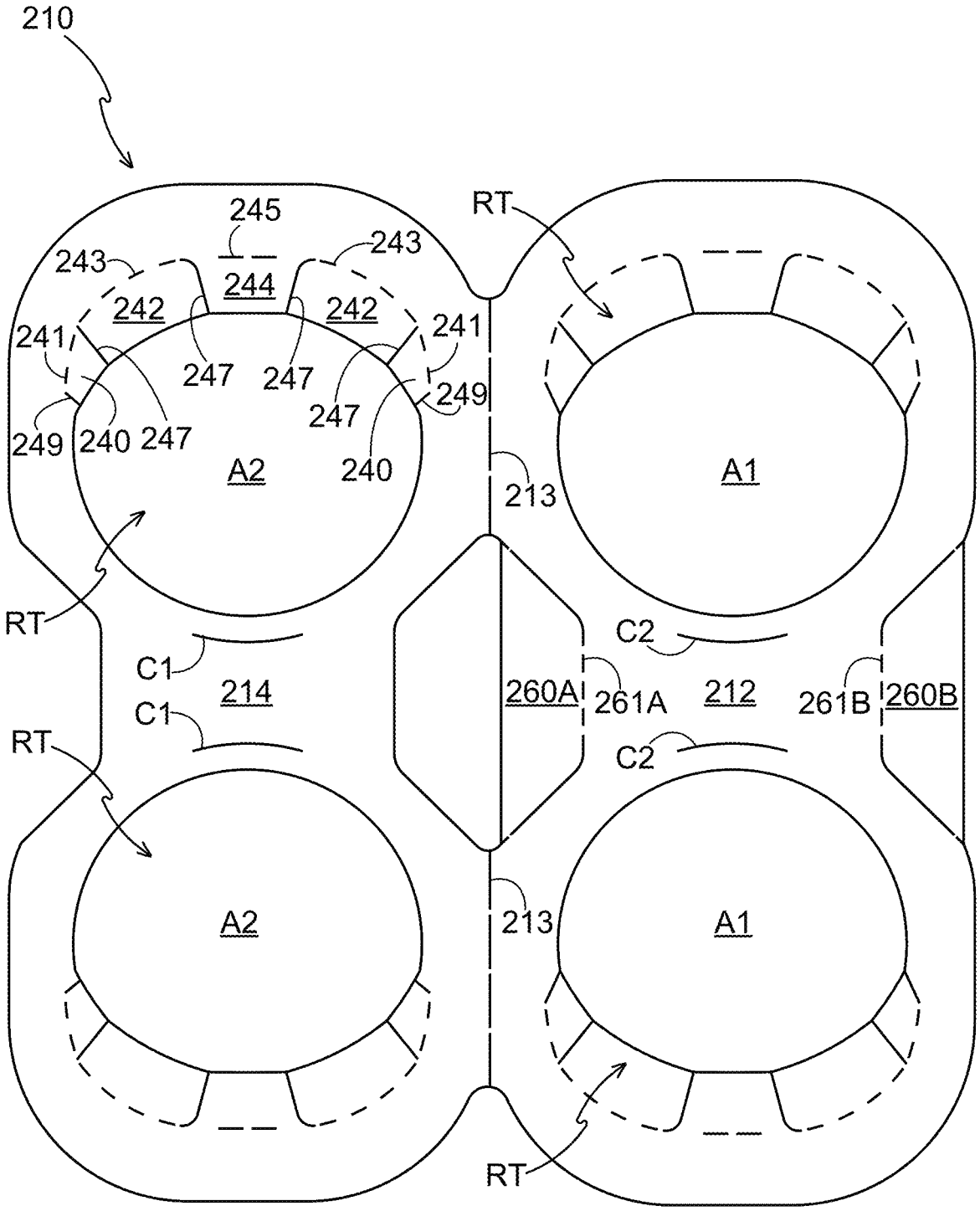
FIG. 7 is a plan view from above of a blank for forming a carrier according to a third example.

Turning to FIG. 7, there is illustrated a blank 210 for forming a carrier (not shown) according to a third embodiment. The blank 210 comprises a first main panel 212 and a second main panel 214.

The second main panel 214 is hingedly connected to the first main panel 212 by a hinged connection in the form of a fold line 213.

The first main panel 212 is substantially similar in construction to the main panel 112 of the embodiment illustrated in FIG. 6 and described with reference thereto.

The second main panel 214 is substantially similar in construction to the first main panel 212 albeit with the omission of the handle flaps 260A, 260B.

The intermediate portion of the first main panel 212 is separated from the intermediate portion of the second main panel 214 by an aperture A4. The aperture A4 interrupts the fold line 213. The aperture A4 is struck, at least in part, from material which would otherwise form the second main panel 214. Optionally, the aperture A4 may be struck, at least in part, from material which would otherwise form the first main panel 212.

The first main panel 212 comprises at least one at least one article retention structure RT. The first main panel 212 comprises a plurality of article retention structures RT, specifically two article retention structures RT arranged in 1×2 matrix or array. Each of the article retention structures RT comprises an opening or aperture A1. The article retention structures RT of the embodiment of FIG. 6 are substantially similar in construction to the article retention structures RT of FIG. 1 and will not be described in further detail.

The second main panel 214 comprises at least one at least one article retention structure RT. The second main panel 214 comprises a plurality of article retention structures RT, specifically two article retention structures RT arranged in 1×2 matrix or array. Each of the article retention structures RT comprises an opening or aperture A2. The article retention structures RT of the embodiment of FIG. 6 are substantially similar in construction to the article retention structures RT of FIG. 1 and will not be described in further detail.

Each article retention structure RT in the second main panel 214 is arranged to be disposed in vertical registry or alignment with a respective article retention structure RT in the first main panel 212 when the second main panel 214 is folded into face-to-face relationship with the first main panel 212. In this way the blank 210 forms a two-ply handle structure.

Figure 9:
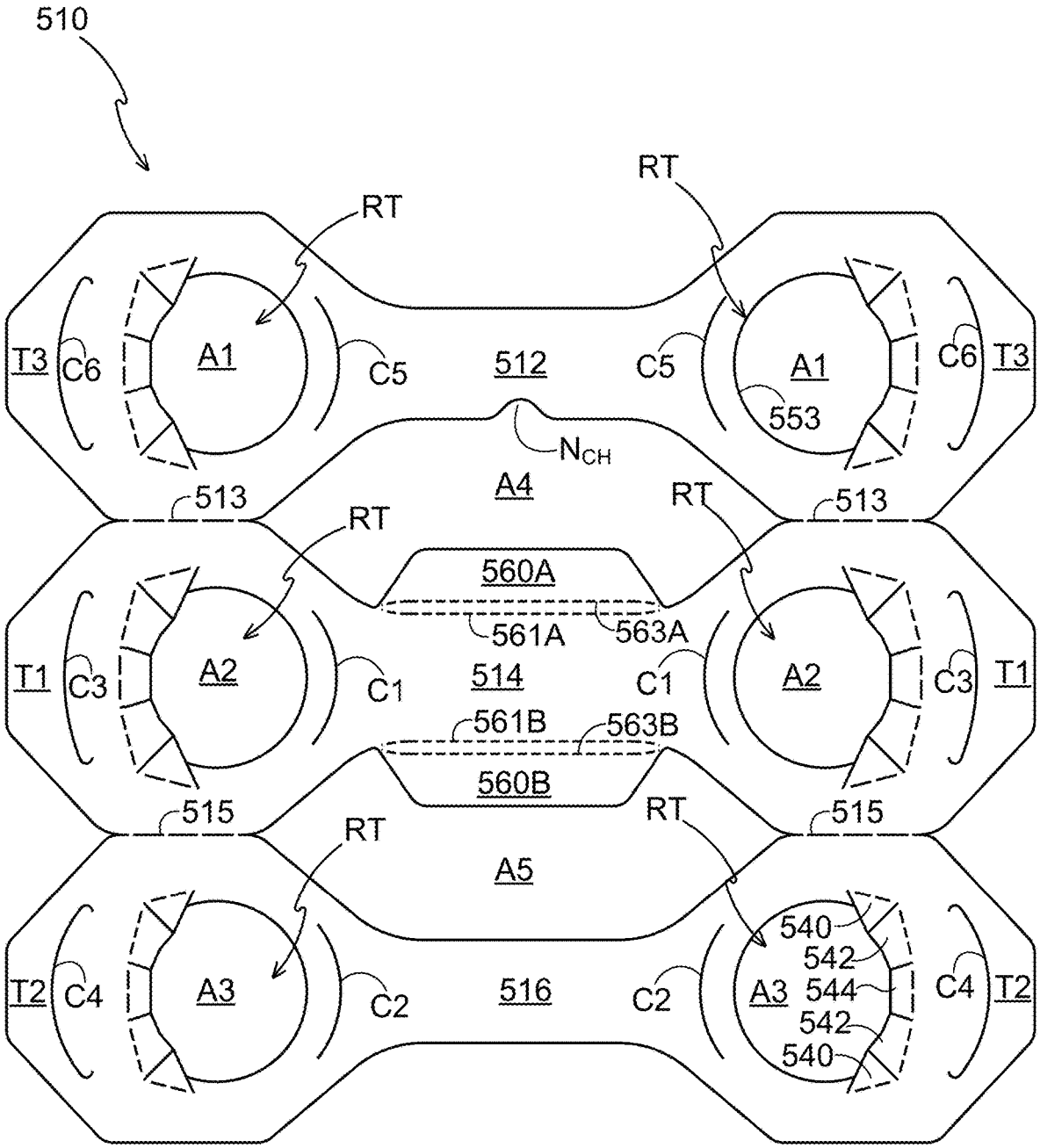
FIG. 9 is a plan view from above of a blank for forming a carrier according to a fifth example.

Referring to FIG. 9 there is shown a blank 510 for forming a carrier according to a fifth embodiment. The blank 510 is substantially similar in construction to the blank of FIG. 1 albeit with the inclusion of additional pull tabs T3, relief cuts C5, and control cuts C6.

The article retention structures RT in the first panel 512 comprise a third relief cut C5. The third relief cut C5 may comprise a circumferential cut line about a portion of the toothless region and spaced apart from the cut line 553 defining the toothless region about the aperture A1.

The first panel 512 may comprise at least one third relief cut C5, the first panel 512 may comprise a pair of third relief cuts C5. The first panel 512 may comprise a third relief cut C5 arranged to extend partially about the aperture A1 or each article retention structure RT provided therein.

The third relief cuts C5 may be non-linear in shape and may be arcuate in shape. The third relief cuts C5, when circular in shape, may have a radius of curvature greater than the radius of curvature of the cut line 553, and may be concentrically arranged with respect to the cut line 553.

Each of the third relief cuts C5 may be disposed between the aperture A1 and the intermediate or waisted portion of the first panel 512.

The relief cuts C1, C2, C5 may improve or increase the flexibility of the article carrier when using the handle H to remove the package from a shelf or storage device. The relief cuts C1, C2, C5 may allow the article carrier to flex, deform, or bend whilst preventing or inhibiting disengagement of the article retention structures RT from the article B, particularly the inner or toothless edge.

The first panel 512 may comprise a pull tab T3 at each end thereof. The pull tab T3 may be defined by a tapered tongue portion integral with the first panel 512. The pull tab T3 forms a release feature to enable a consumer or user to release the article B being packaged from the article carrier.

Each release feature may comprise a control cut C6 defined in the first panel 512. A third control cut C6 in the first panel 512 may define, at least in part, a third or intermediate pull tab T3.

The first panel 512 may comprise a cutaway $N_{CH}$ in the form of a recess or notch struck from a portion of the waisted intermediate portion. The cutaway $N_{CH}$ may be struck from a side edge of the waisted intermediate portion of the first panel 512 facing towards the waisted intermediate portion of the second panel 514. The cutaway $N_{CH}$ may be employed to control the orientation of the blank 510 during assembly of the blank 510 into a carrier, and may be engaged by a tool, during application of glue and folding of the blank 510. In some embodiments, the cutaway $N_{CH}$ may facilitate gluing of the upper layer, second panel 514 directly to the lower layer, third panel 516.

Referring to FIG. 10 there is shown a blank 610 for forming a carrier according to a sixth embodiment. The blank 610 is substantially similar in construction to the blank 510 of FIG. 9 albeit with the engaging teeth 540, 542, 544 have been omitted or removed from the article retention structures RT provided in the first panel 512. The article retention structures RT in the first panel 612 of the embodiment shown in FIG. 10 each comprise a receiving opening configured and arranged to allow the engaging teeth 540, 542, 544 of the lower layer, third panel 616, to pass therethrough.

The hinged connections F1 of the set of teeth or tabs 640, 642, 644 in the upper layer 614 is offset with respect to the hinged connections F3 of the set of teeth or tabs 640, 642, 644 in the lower layer 16.

An edge portion EP of the aperture A1 of the article retention structures RT in the intermediate layer 12 is configured to lie between hinged connections F1 and the hinged connections F3 when the first panel 612 is folded between the second and third panels 614, 616.

Figure 11:
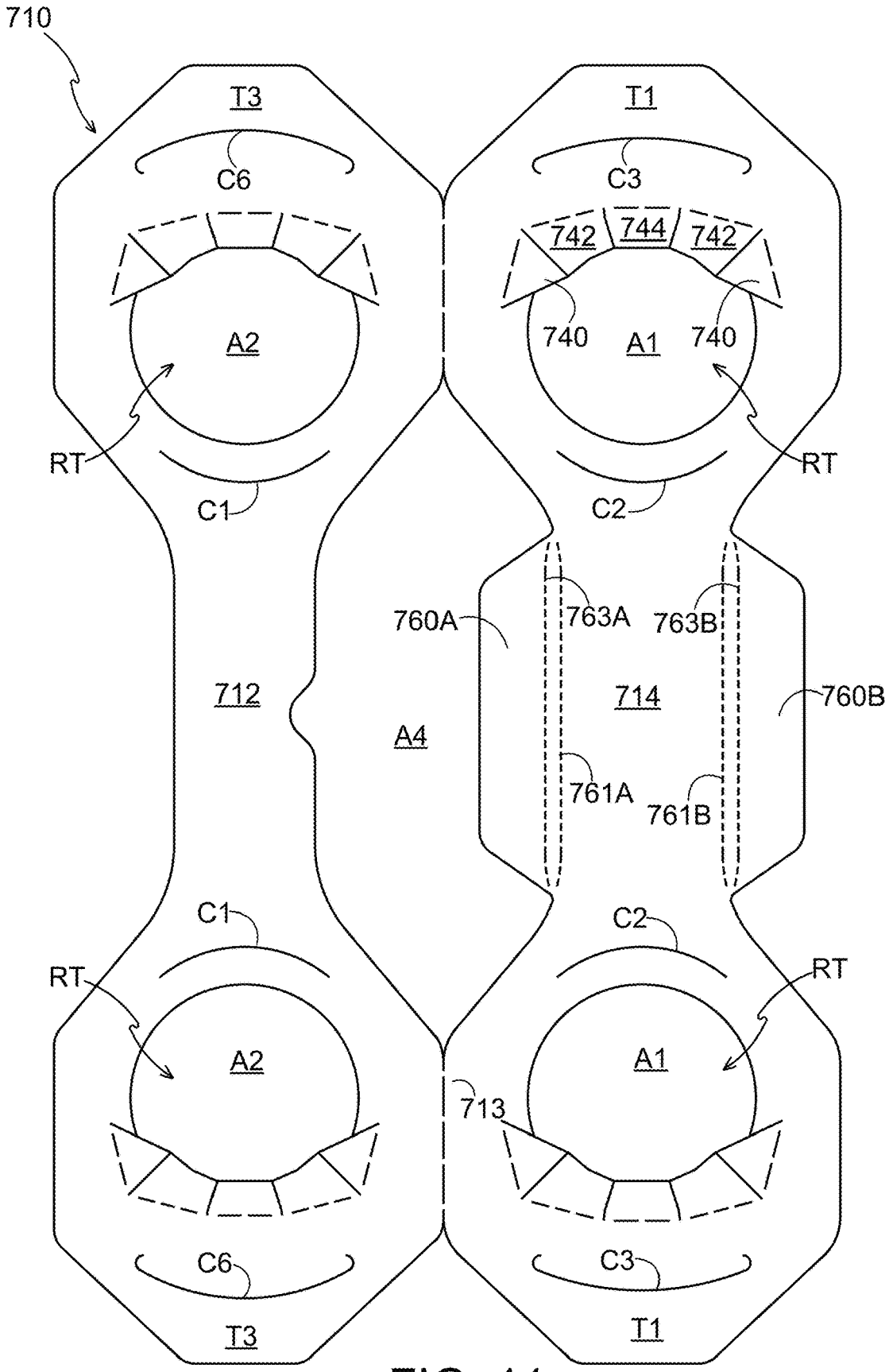
FIG. 11 is a plan view from above of a blank for forming a carrier according to a seventh example.

Referring to FIG. 11 there is shown a blank 710 for forming a carrier according to a seventh embodiment. The blank 710 is substantially similar in construction to the blank 510 of FIG. 9 albeit arranged to form a carrier of a two-ply construction. The third panel 516 has been omitted from the embodiment of FIG. 11, the first panel 712 forms a lowermost layer of the carrier.

Figure 12:
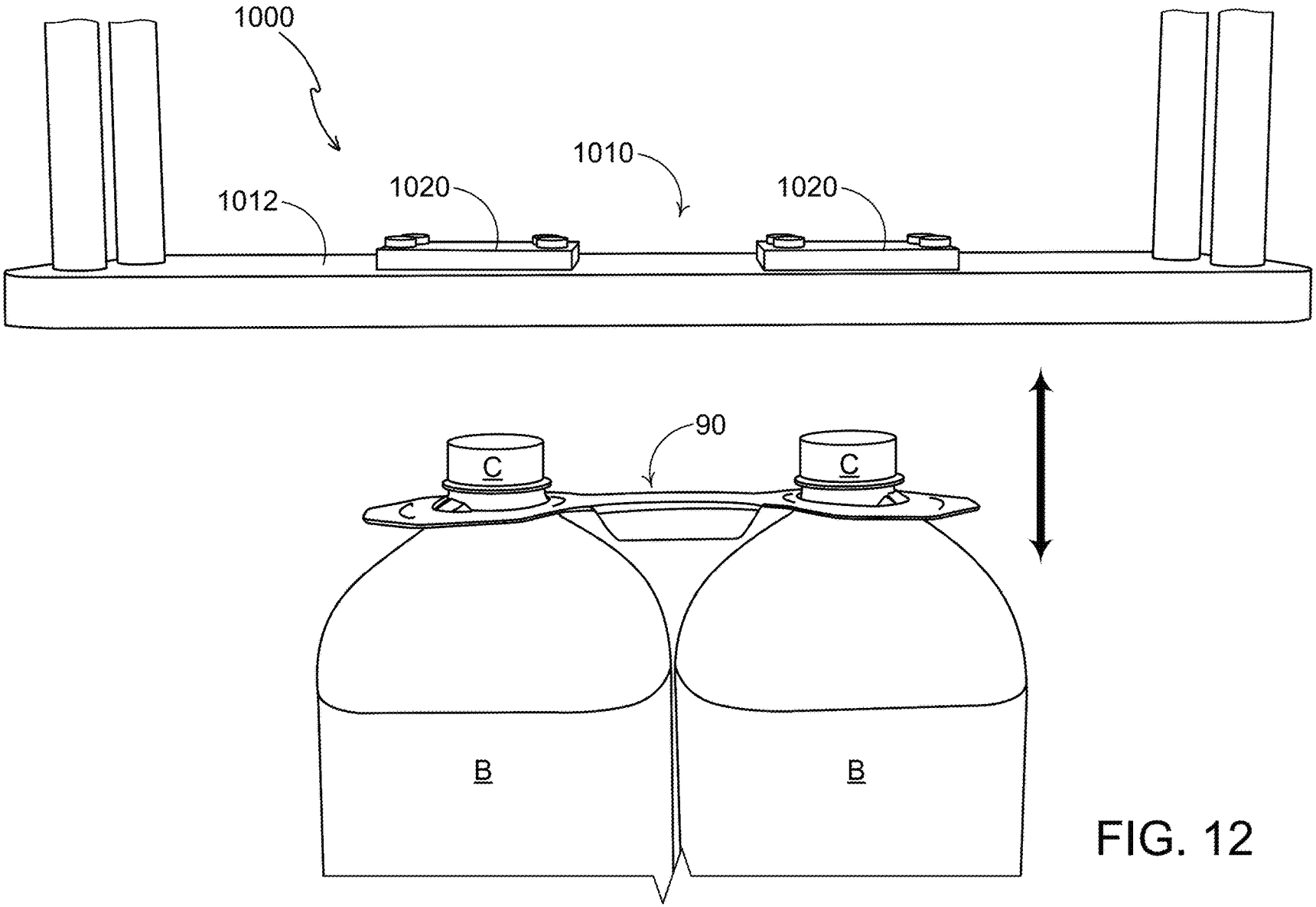
FIGS. 12 and 13 illustrate an apparatus for applying the blanks according to various examples to a group of articles.

Turning now to FIG. 12 there is shown an apparatus 1000 for applying a carrier 90, such as but not limited to those described herein, to a pair of articles B. The apparatus 1000 and method will be described by way of example with reference to the carrier 90 shown in FIG. 10, however the apparatus 1000 and method is not limited to application of the carrier 90 of FIG. 10.

The apparatus 1000 comprises an applicator 1010 including an applicator plate 1012. The applicator 1010 may be adapted to pick up a carrier 90 from a hopper or magazine (not shown). The applicator may comprise a vacuum system (not shown) including a vacuum cup for engaging and removing the carrier 90 from the hopper. In other embodiments, alternative gripping devices may be employed as known in the art. In still other embodiments, the carrier 90 may be picked up, aligned and placed upon the group of articles B by a separate apparatus (not shown) before entering a working region of the apparatus 1000.

Figure 13:
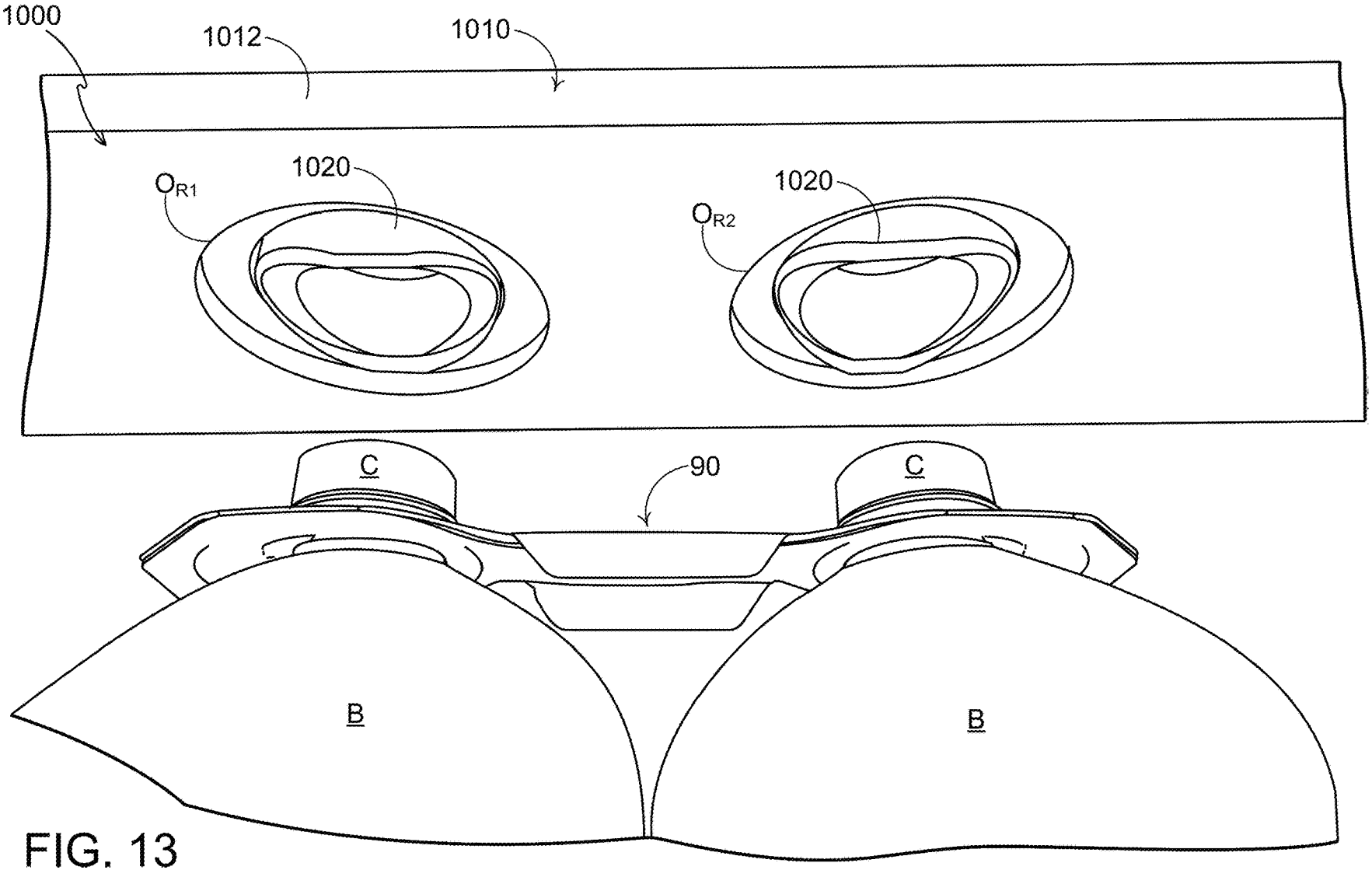
Figure 14:
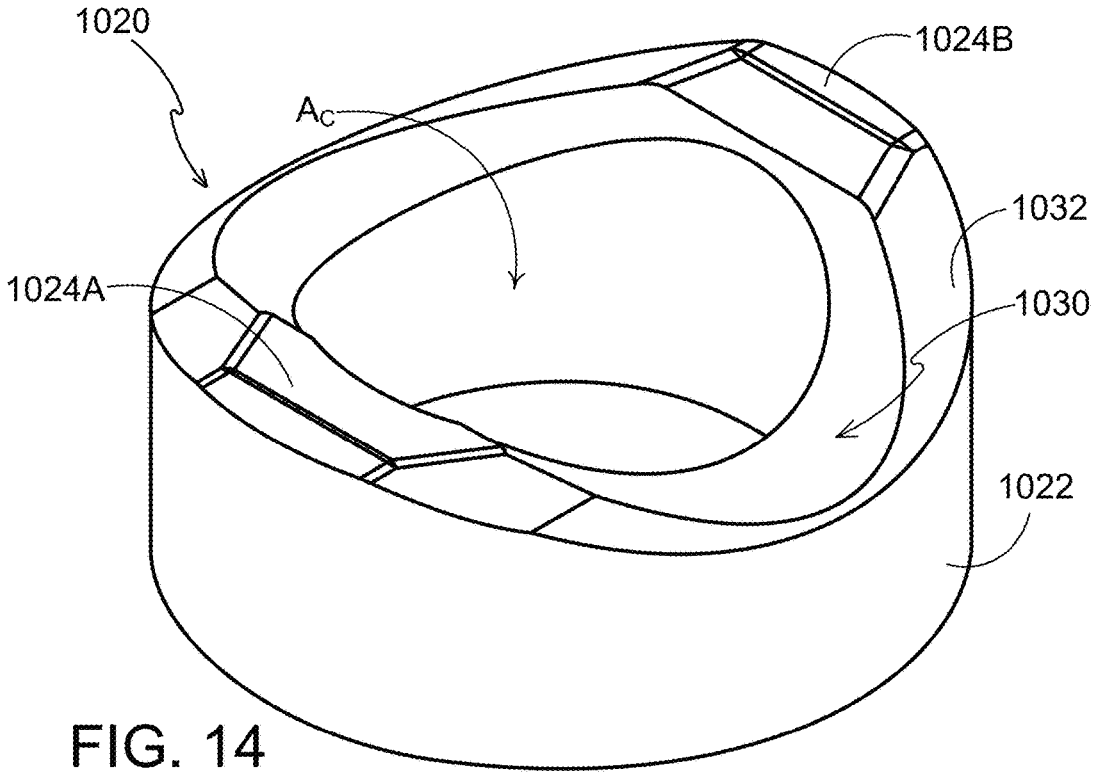
FIG. 14 is an isometric view from below illustrating a component forming part of the apparatus of FIGS. 12 and 13.
Figure 15:
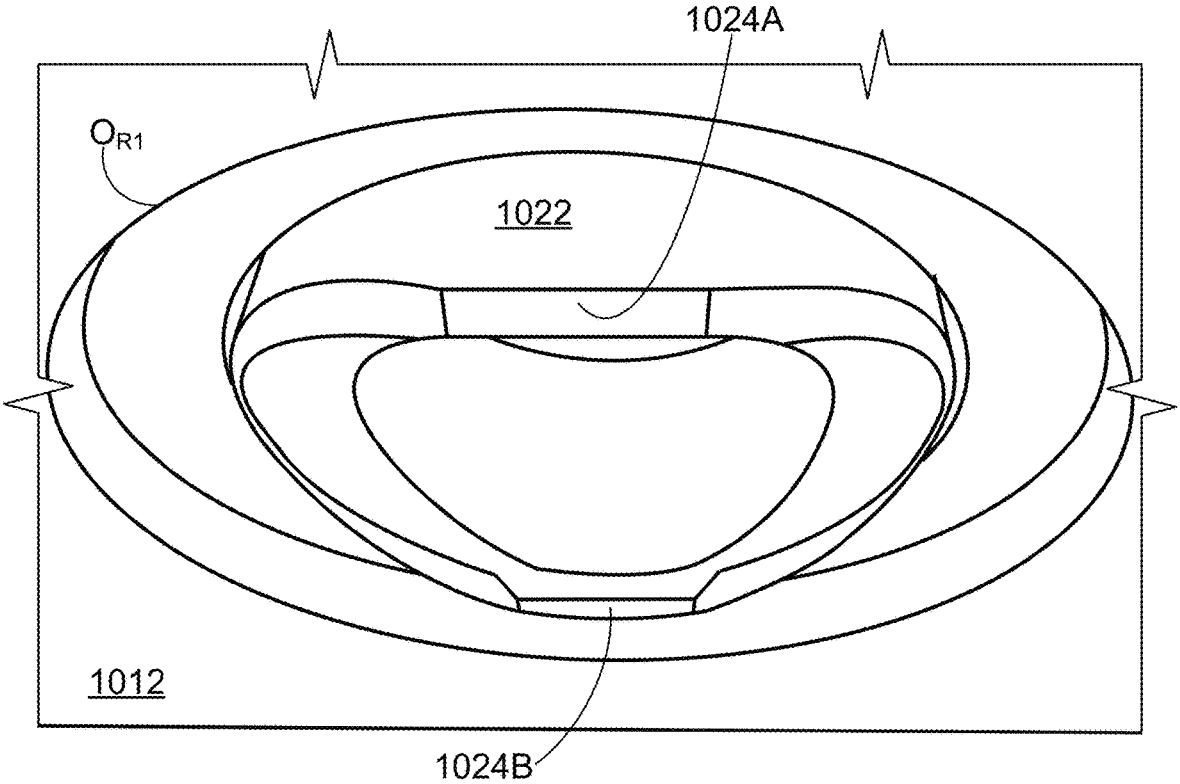
FIG. 15 is an enlarged view of a portion of the apparatus shown in FIG. 13.

FIGS. 13 and 15 illustrate the applicator plate 1012 from below, the applicator plate 1012 comprises at least one orifice $O_{R1}$, $O_{R2}$, the illustrated embodiment comprises a pair of orifices $O_{R1}$, $O_{R2}$. The orifices $O_{R1}$, $O_{R2}$ define an open end of a bore in the applicator plate 1012. The bore may be blind, partially blind or open. In the illustrated embodiment, the bore is partially blind. A bushing 1020 is disposed in the bore and comprises an annular side wall 1022 and provides a saddle 1030, best shown in FIG. 14, at a lower end thereof. The saddle 1030 provides a pair of opposed abutment surfaces 1024A, 1024B. A "U" shaped recess is provided between the pair of opposed abutment surfaces 1024A, 1024B. In alternative embodiments, it will be appreciated that a pair of opposed abutment surfaces may be provided by alternative structures mounted to or integral with the applicator plate 1012. The pair of opposed abutment surfaces are spaced apart from each other sufficient that a portion of an article B can be received therebetween. In the illustrated embodiment, the portion of the article B received is an end closure C of a bottle.

The bushing 1020 is oriented with respect to the carrier 90 such that the pair of opposed abutment surfaces 1024A, 1024B make contact and apply force or pressure to the second panel 514 at contact points PP, as shown in FIG. 10. The carrier 90 comprises a pair of contact points PP on opposing sides of each article retention structure RT. Each saddle 1030 transversely straddles one of the article retention structures RT. The "U" shaped recesses of the saddle 1030 extend in a longitudinal direction, and the U" shaped recess of one saddle 1030 is collinear with the U" shaped recess of the other saddle 1030.

Figure 16B:
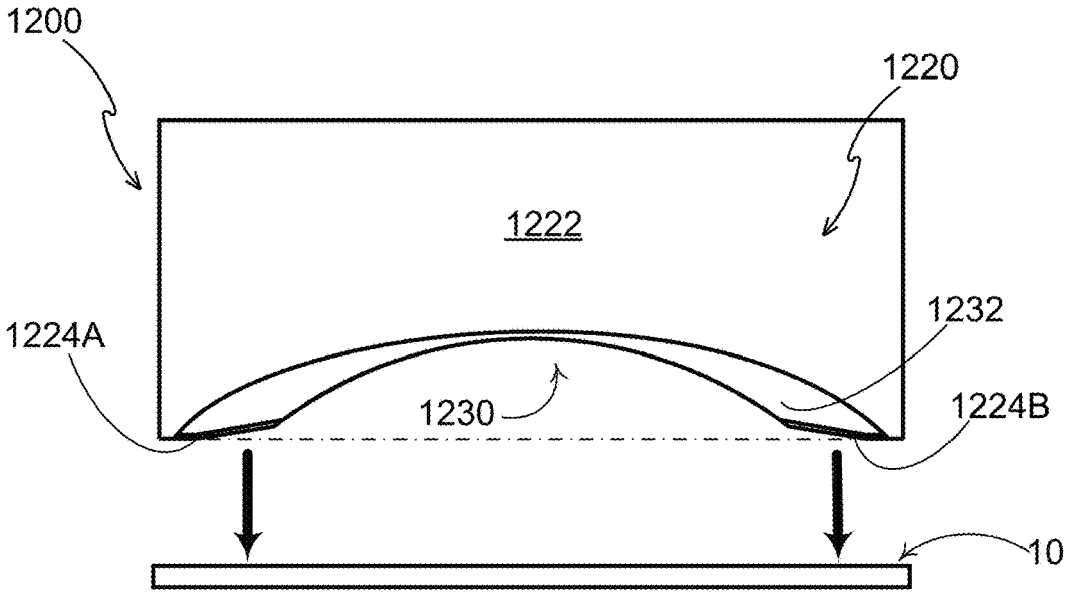
FIG. 16B schematically illustrates an alternative component for application of a blank according to examples of the present disclosure.
Figure 16:
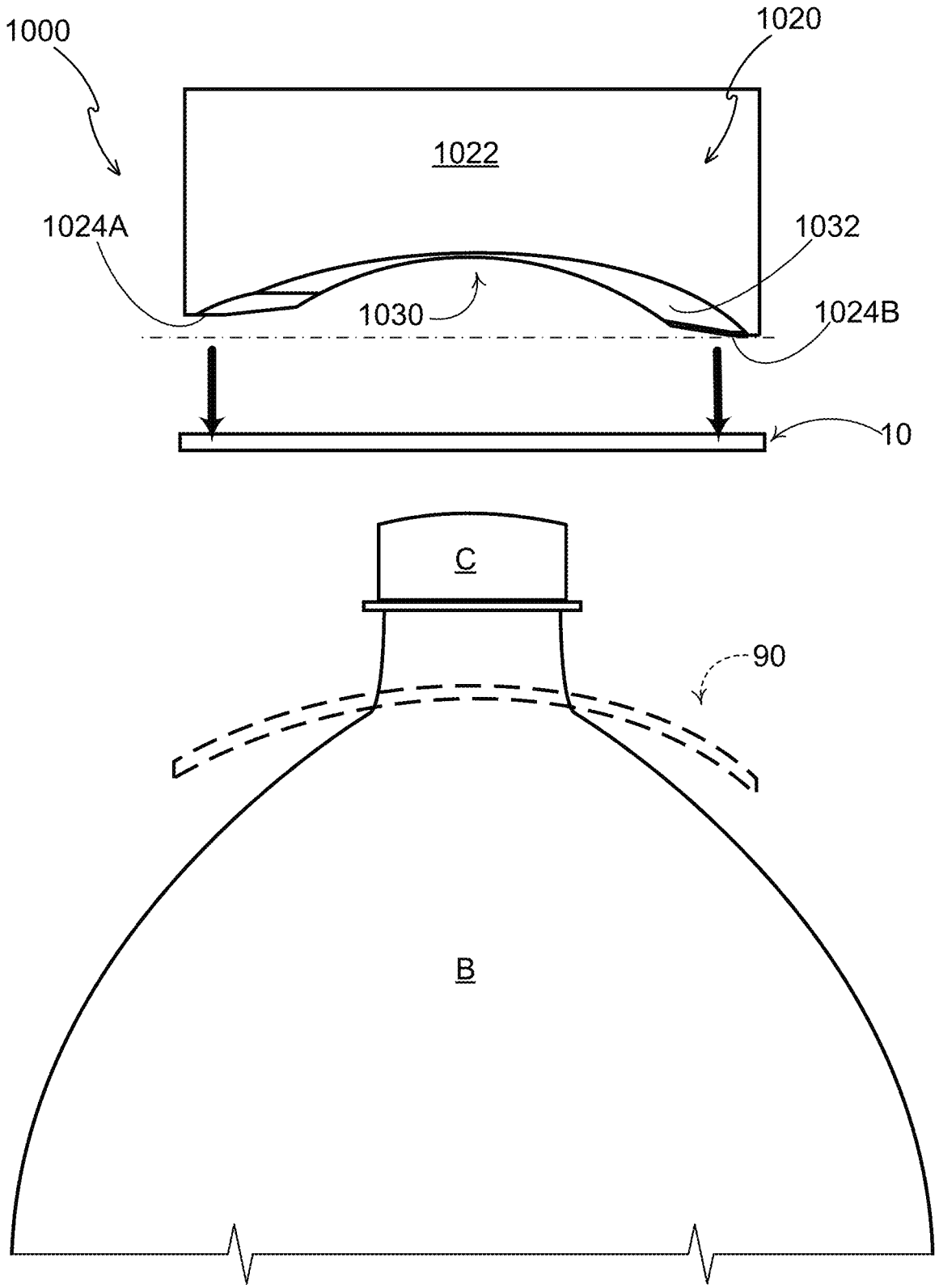
FIG. 16 schematically illustrates application of a blank, according to examples of the present disclosure, to a group of articles.

One of the pair of opposed abutment surfaces 1024A, 1024B is disposed at a different elevation to the other one of the pair of opposed abutment surfaces 1024A, 1024B, best illustrated in FIG. 16, in which the applicator plate 1012 has been omitted for illustrative purposes. In this way the applicator 1010 applies force or pressure unevenly or asynchronously to the side or longitudinal edges of the carrier 90. The applicator 1010 unevenly or unequally displaces the opposing sides of the carrier 90 from a planar condition. A first abutment surface 1024A is disposed at a first elevation and is configured to make contact with a contact point PP along a first side of the carrier 90 before a second abutment surface 1024B, which is disposed at a higher elevation, makes contact with a second contact point PP along a second side of the carrier 90.

FIG. 16B illustrates an alternative bushing 1220, having an annular wall 1222, which is substantially similar to the bushing of FIGS. 13 to 16 albeit a pair of opposed abutment surfaces 1024A, 1024B are disposed at the same elevation. In this way the bushing 1220 applies force or pressure evenly or synchronously to the side or longitudinal edges of the blank 10 (or carrier 90). The bushing 1220 evenly or equally displaces the opposing sides of the blank 10 from a planar condition. The first abutment surface 1024A makes contact with a contact point along a first side of the blank 10 and a second abutment surface 1024B makes contact with a second contact point along a second side of the blank 10 at substantially the same time.

The annular wall 1022 of the bushing 1020 may be inclined downwardly, as viewed in FIG. 14, (albeit upwardly in normal use as shown in FIG. 16) from inside to outside, in the region of the "U" shaped recess between the pair of opposed abutment surfaces 1024A, 1024B.

The "U" shaped recesses in the saddles 1030 allow, or provide a void, into which the engaging tabs 40, 42, 44 may be displaced when the carrier 90 is applied to the articles B. In this way the bushing 1020 does not interfere or inhibit movement of the engaging tabs 40, 42, 44.

The carrier 90, or at least portions thereof surrounding the article retention structures R may adopt an inverted "U" shaped form in response to engagement by the saddles 1030 whilst being applied to the articles B.

Figure 17:
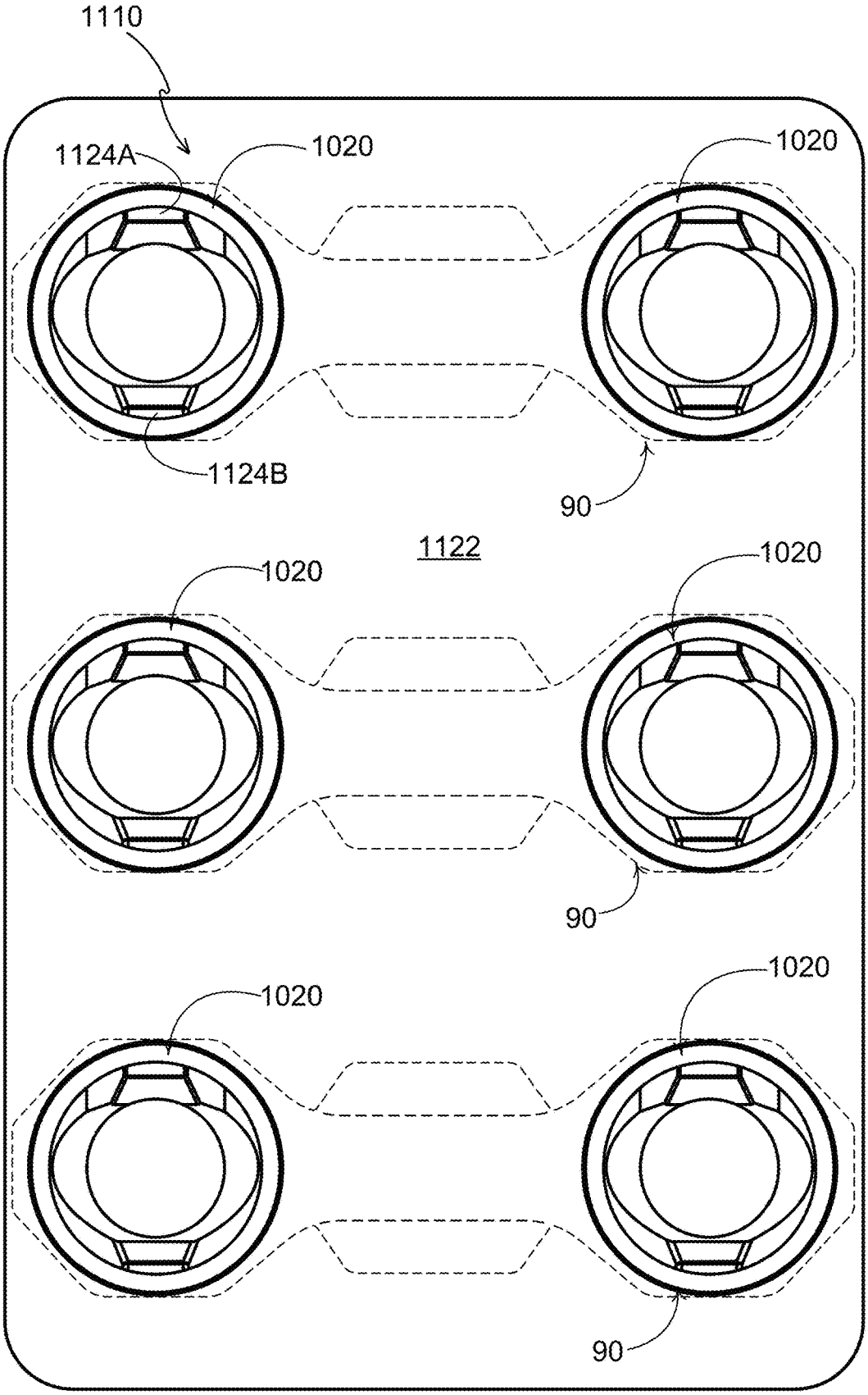
FIG. 17 is a plan view from below illustrating a component for forming part of an apparatus according to examples of the present disclosure.

Referring now to FIG. 17 there is shown an alternative embodiment of the applicator 1110 having an applicator plate 1112 configured to apply three carriers 90 (outline positions of the carriers 90 are indicated by dashed lines in FIG. 17) simultaneously to three groups or pairs of articles B. The applicator plate 1112 comprises six bushings 1120 mounted thereto arranged in a 2×3 matrix or array. In other embodiments, it will be appreciated that other configurations may be employed, to apply a different number of carriers or package a different number of articles as desired.

In some embodiments, bushings 1020; 1120 may be retro fitted to an existing applicator plate to adapt an existing packaging machine to apply paperboard carriers to articles B.

Figure 18A:
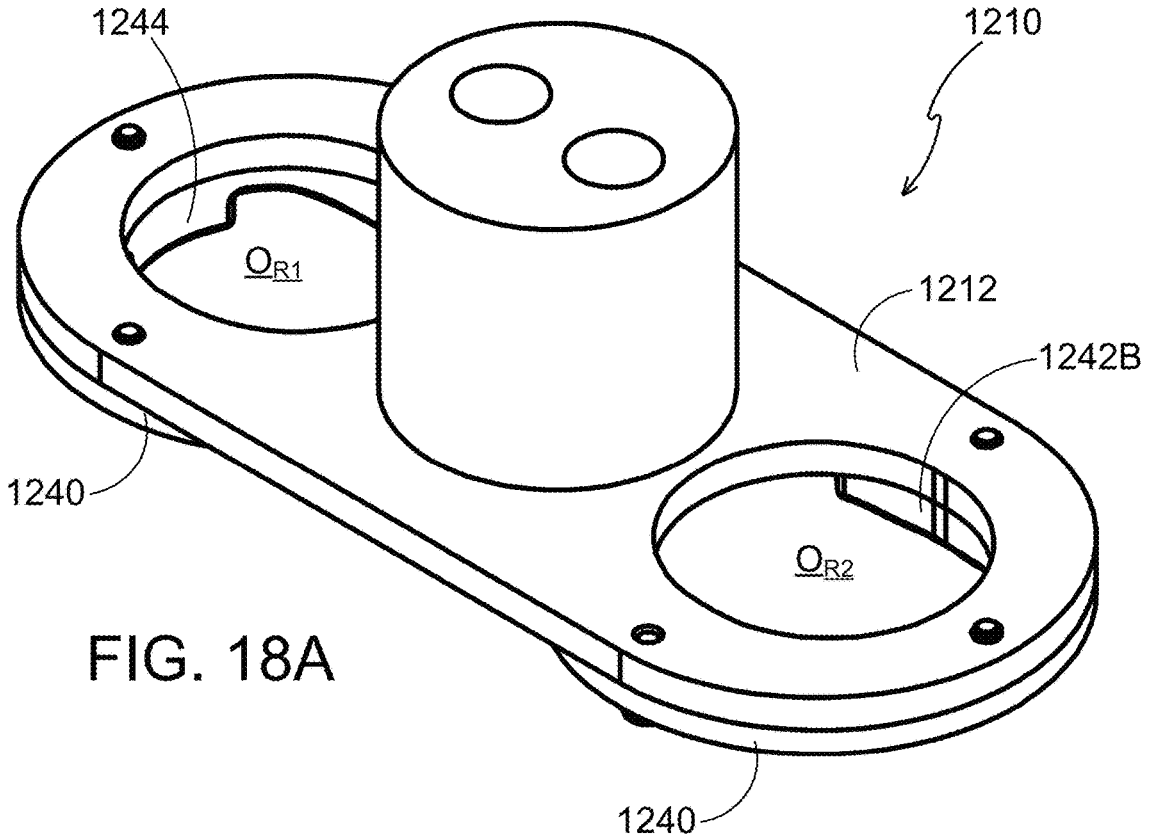
FIGS. 18A and 18B are perspective views, from above and below respectively, illustrating an apparatus according to examples of the present disclosure for applying the blanks, according to various examples, to a group of articles.
Figure 18B:
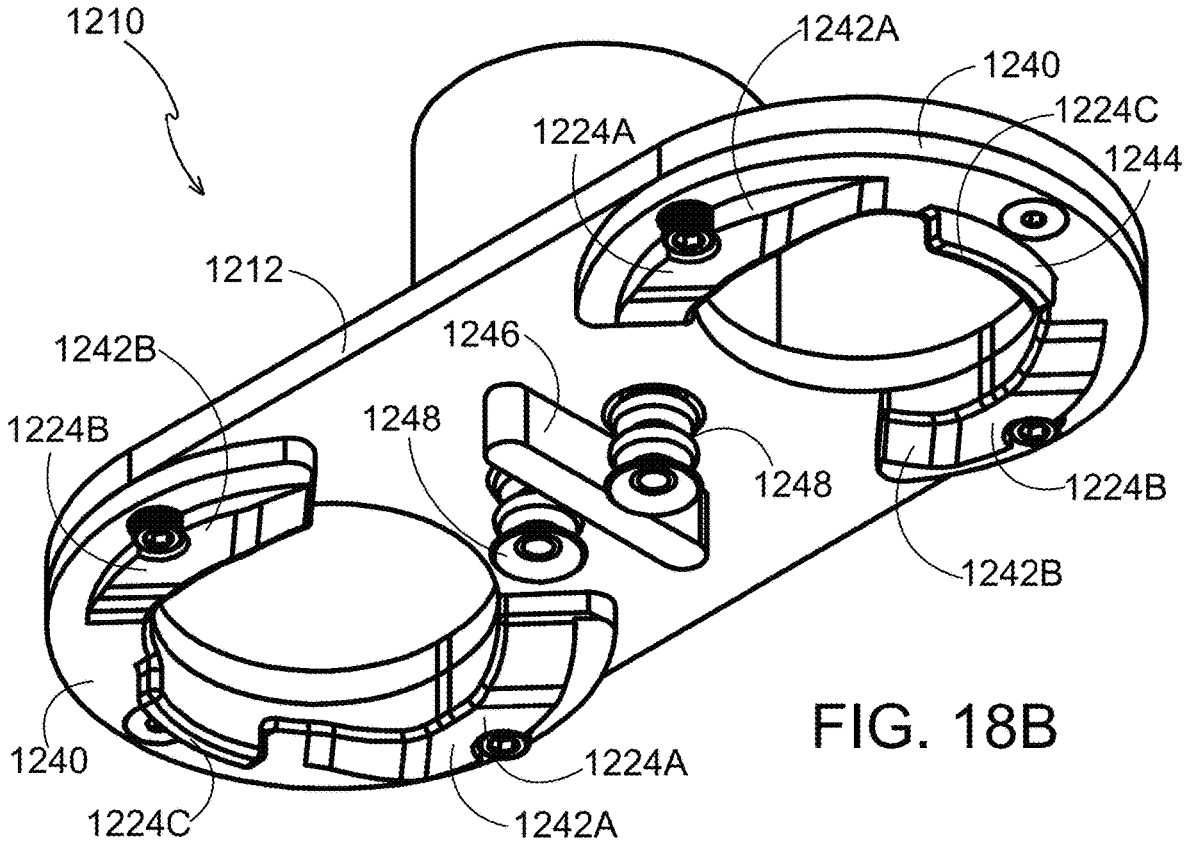
Figure 19A:
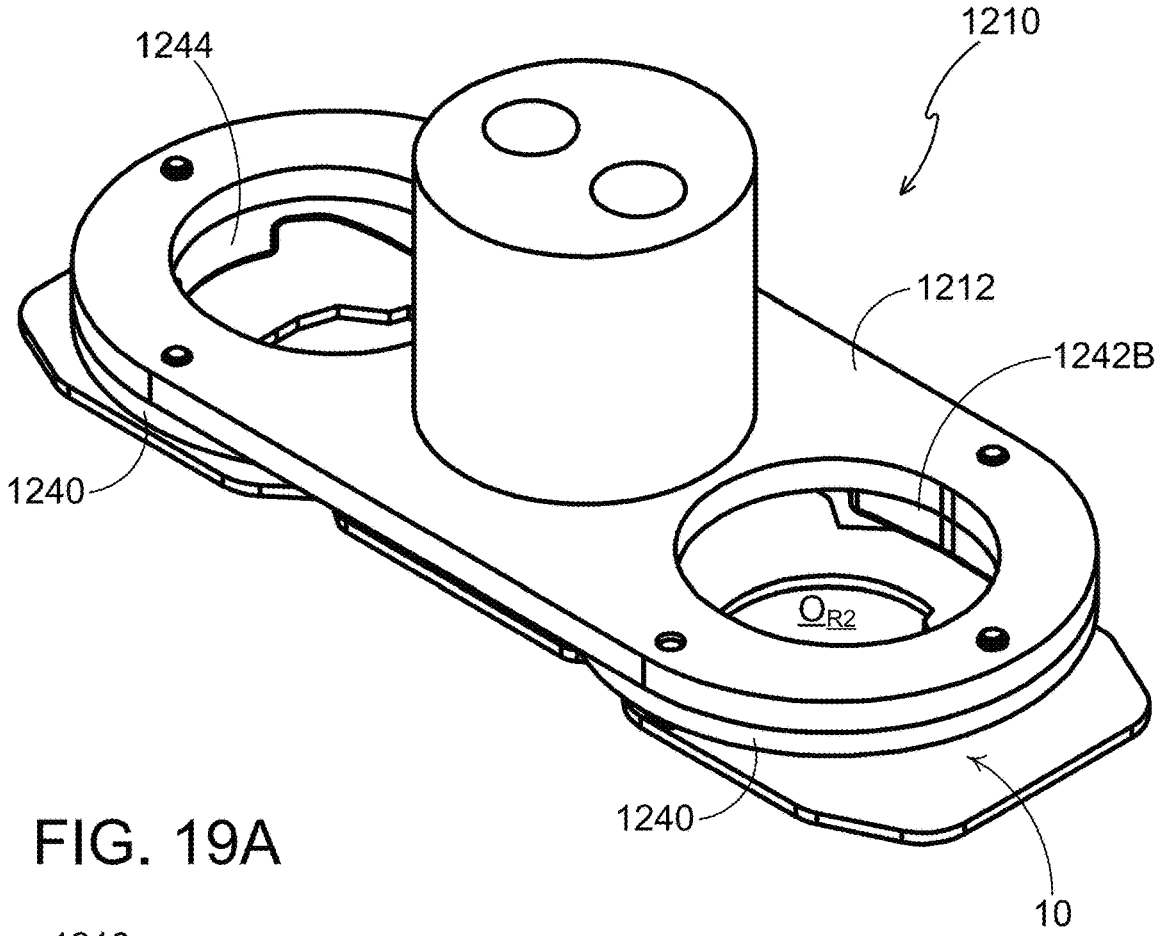
FIGS. 19A and 19B are perspective views, from above and below respectively, illustrating the apparatus of FIGS. 18A and 18B engaging a blank according to various examples.
Figure 19B:
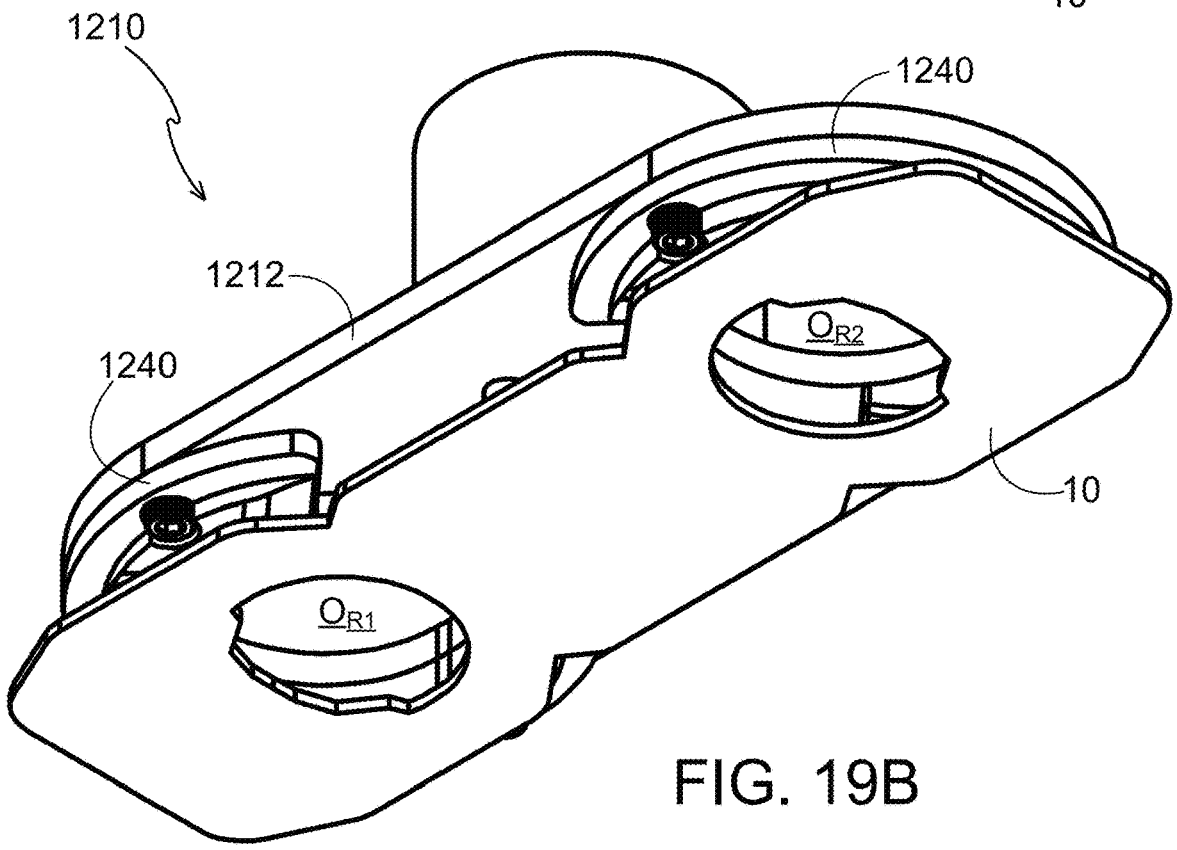

Referring now to FIGS. 18A and 18B there is shown an alternative example of the applicator 1210 having an applicator plate 1212 configured to apply a carrier 90 to a pair of articles B. The applicator plate 1212 comprises two openings or orifices $O_{R1}$, $O_{R2}$ for receiving portions of a respective article B. The orifices $O_{R1}$, $O_{R2}$ may also be arranged to receive upper portion of posts 1350 supporting blanks 10; 110; 210; 410; 510; 610; 710 in a blank hopper. The applicator plate 1212 comprises an engagement device for picking up or gripping a blank 10; 110; 210; 410; 510; 610; 710. The engagement device comprises at least one suction cup 1248 coupled to a vacuum system extending from a lower surface of the applicator plate 1212; the illustrated embodiment comprises two suction cups 1248. The suction cups 1248 are disposed on a notional medial line bisecting the applicator plate 1212 in a longitudinal direction. The applicator plate 1212 comprises a brace or support, also referred to herein as an abutment projection, in the form of a beam 1246. The beam 1246 extends from a lower surface of the applicator plate 1212 transversely of the applicator plate 1212. The beam 1246 may be disposed between the pair of suction cups 1248. The beam 1246 is disposed on a second notional medial line bisecting the applicator plate 1212 in a transverse direction. The beam 1246 provides an engaging surface for abutting the blank 10; 110; 210; 410; 510; 610; 710. The beam 1246 may facilitate maintaining the blank 10; 110; 210; 410; 510; 610; 710 in a flat or planar condition when engaged by the pair of suction cups 1248.

The applicator plate 1212 comprises a plurality of projections 1242A, 1242B, 1244 extending from the lower surface thereof. The projections 1242A, 1242B, 1244 at least partially surround the article receiving orifices $O_{R1}$, $O_{R2}$. A pair of projections 1242A, 1242B are disposed on opposite sides of each article receiving orifice $O_{R1}$, $O_{R2}$ and provide pair of opposed abutment surfaces 1224A, 1224B, a first abutment surface 1224A on a first side and a second abutment surface 1224B on a second side.

Figure 20B:
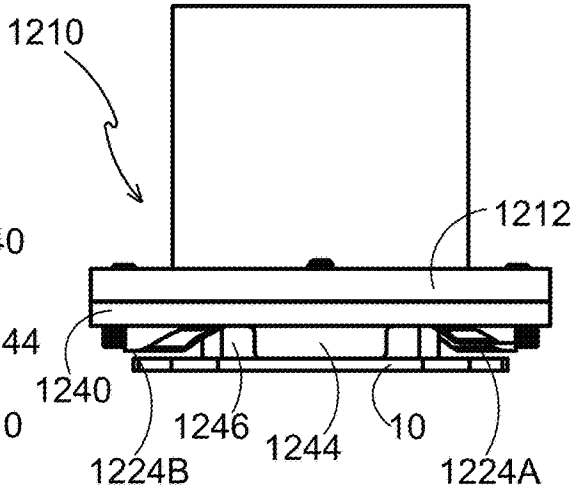
FIGS. 20A, 20B and 20C respectively show a side view, end view and plan view from below of the apparatus of FIGS. 18A and 18B in engagement with a blank according to various examples.
Figure 20A:
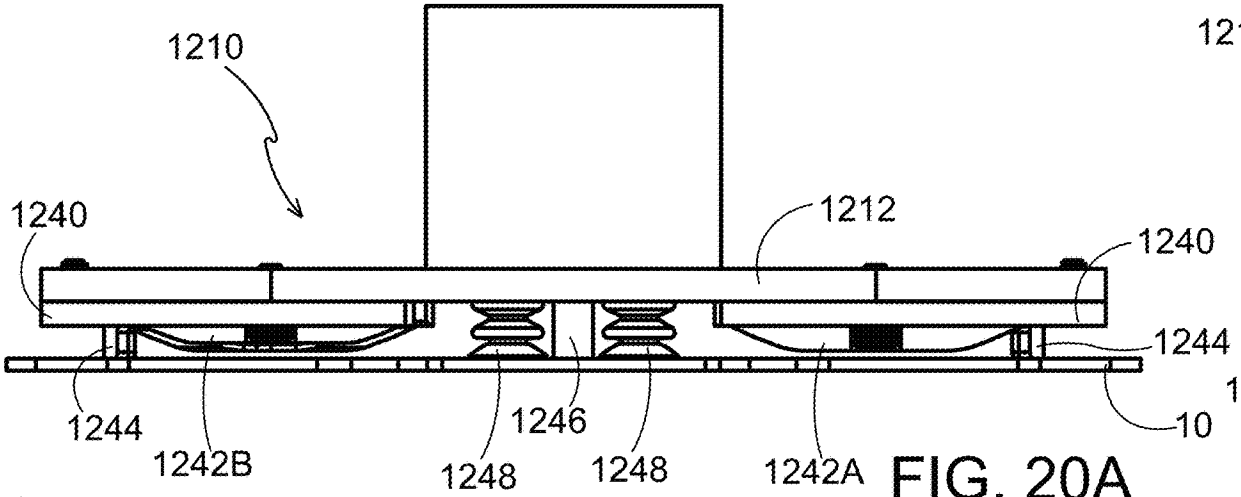
Figure 20C:
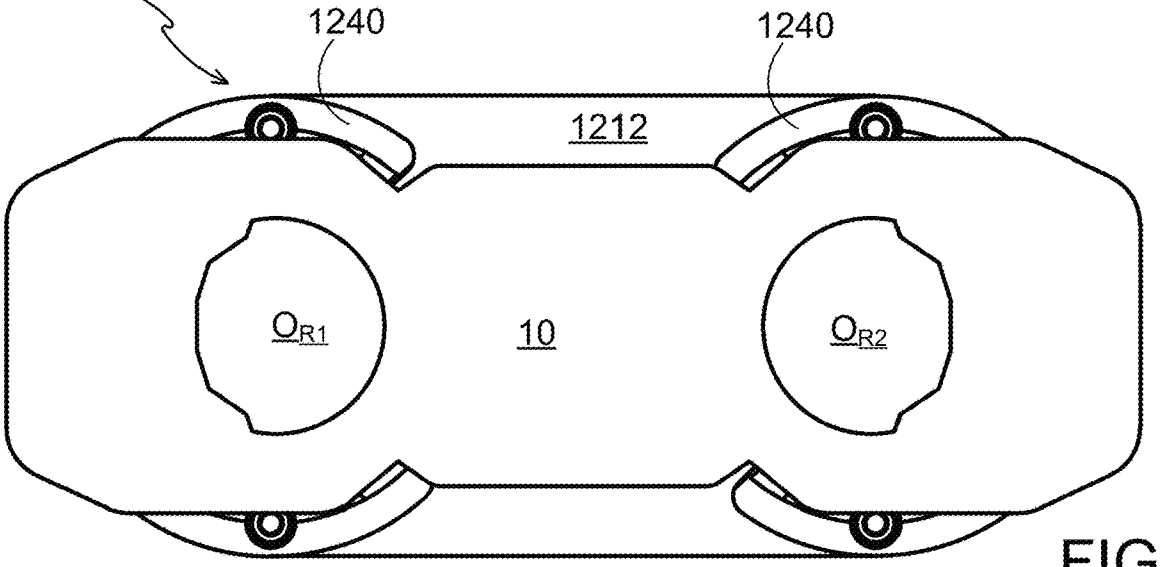
Figure 21B:
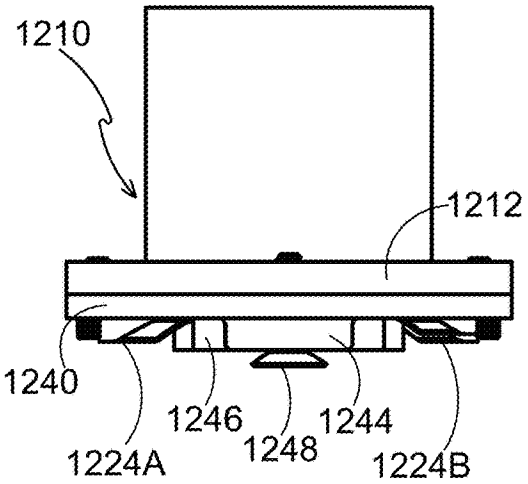
FIGS. 21A, 21B and 21C respectively show a side view, end view and plan view from below of the apparatus of FIGS. 18A and 18B.
Figure 21A:
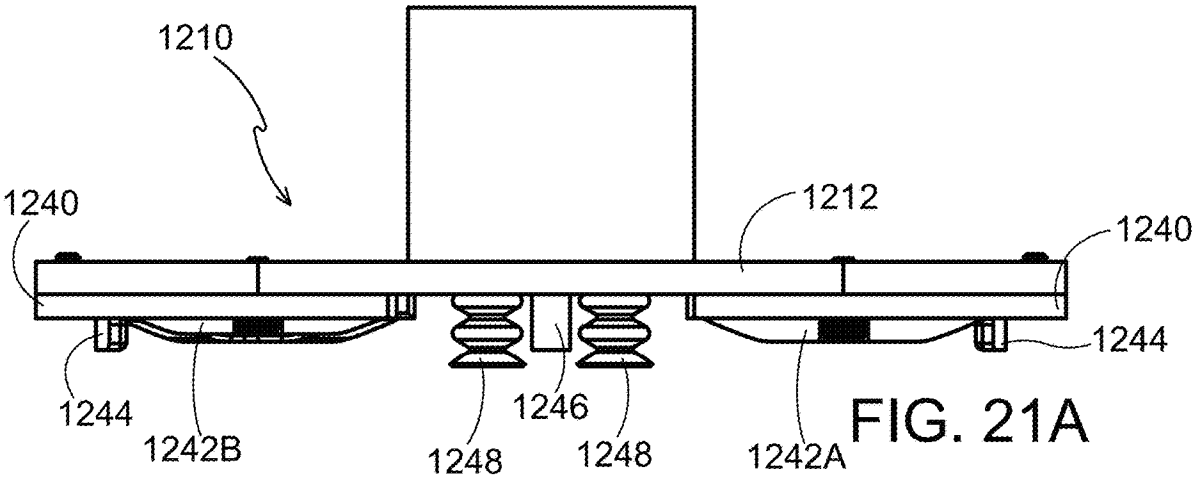
Figure 21C:
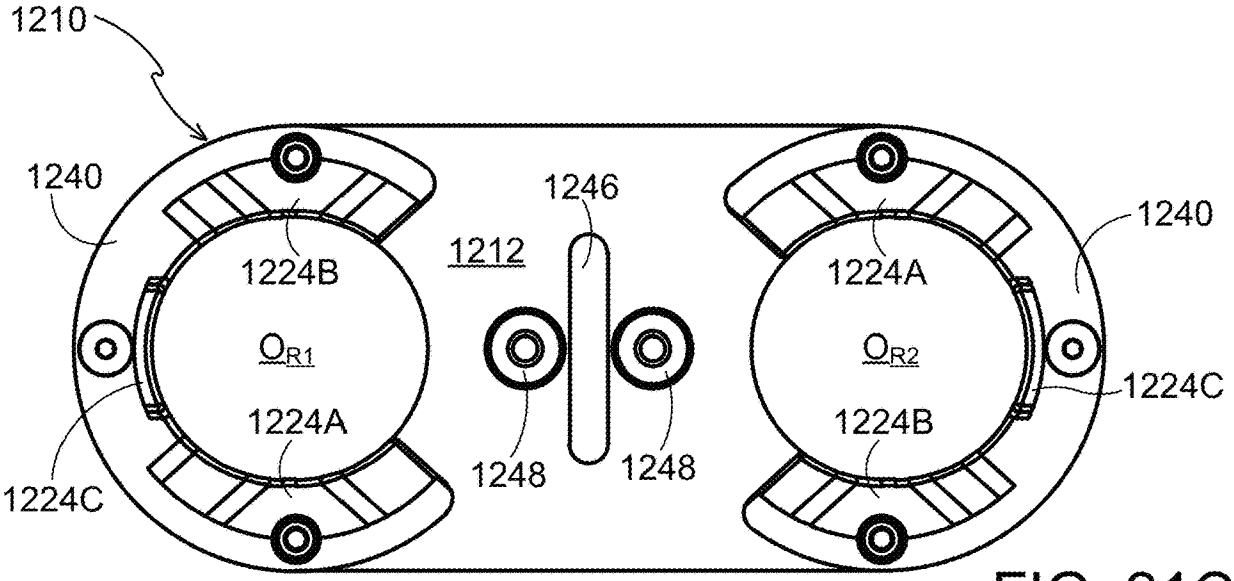
Figure 22A:
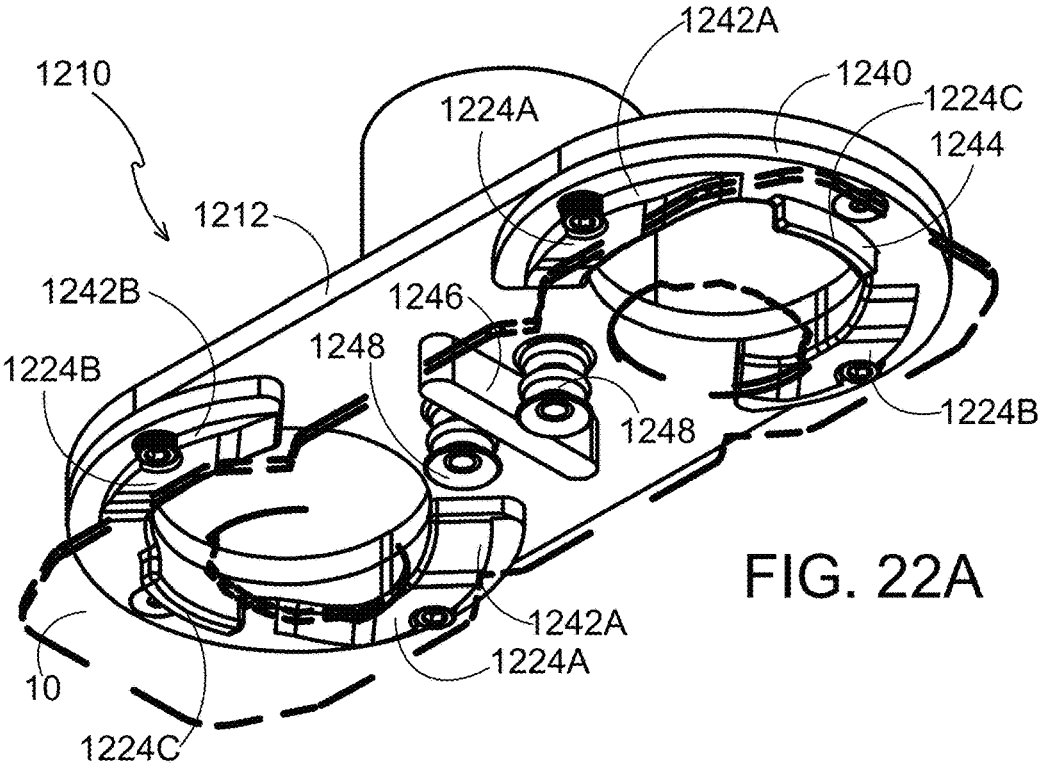
FIG. 22A shows a perspective view from below of the apparatus of FIGS. 18A and 18B in engagement with a blank, according to various examples, in which the blank is illustrated transparently for illustrative purposes.
Figure 22B:
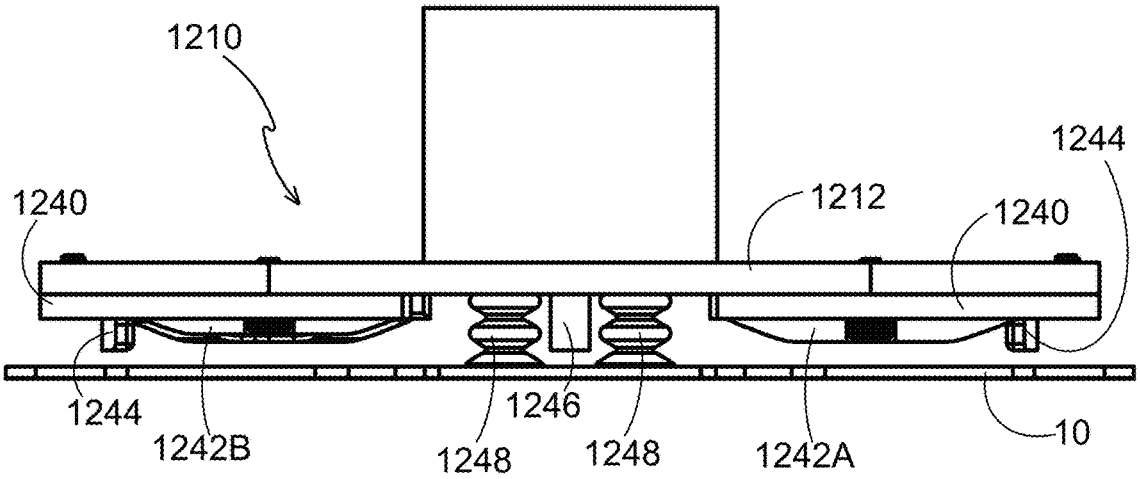
FIGS. 22B and 22C respectively show a side view and end view of the apparatus of FIGS. 18A and 18B in partial engagement with a blank according to various examples.
Figure 22C:
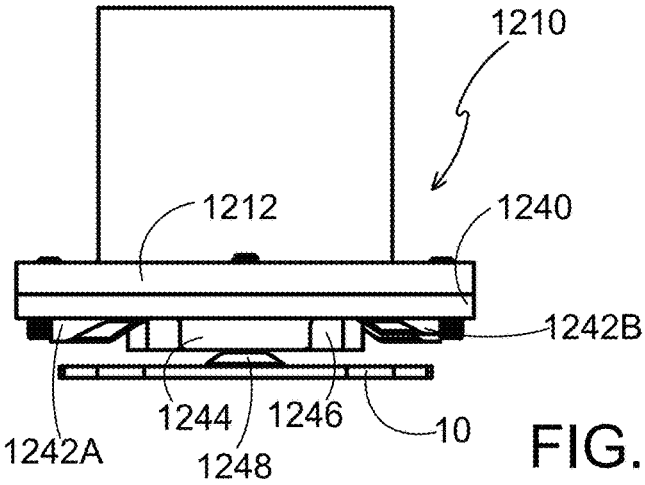

One of the pair of opposed abutment surfaces 1224A, 1224B is disposed at a different elevation to the other one of the pair of opposed abutment surfaces 1224A, 1224B, best illustrated in FIGS. 20A, 20B. In this way the applicator 1210 applies force or pressure unevenly or asynchronously to the side or longitudinal edges of the carrier 90.

The plurality of projections 1242A, 1242B, 1244 comprises an end projection 1244 disposed about a region of each article receiving orifice $O_{R1}$, $O_{R2}$ adjacent to an end of the applicator plate 1212. Each end projection 1244 provides an abutment surface 12240 for engaging the blank 10; 110; 210; 410; 510; 610; 710, the end abutment surfaces 1224C may facilitate engagement of the engaging teeth 40, 42, 44; 140, 142, 144; 240, 242, 244; 440, 442, 444; 540, 542, 544; 640, 642, 644; 740, 742, 744 with the article B.

The end projections 1244 extend from the lower surface of the applicator plate 1212 further than either of the pair of projections 1242A, 1242B, in this way the plurality of projections 1242A, 1242B, 1244 each extend a different distance from the lower surface of the applicator plate 1212.

The end projections 1244 may extend from the lower surface of the applicator plate 1212 by a distance substantially equal to distance that the beam 1246 extends.

The abutment surfaces 1224C of the end projections 1244 are coplanar with the abutment surface of the beam 1246. The blanks 10; 110; 210; 410; 510; 610; 710 can be engaged by the suction cups 1248 and brought into abutment with abutment surfaces 1224C of the end projections 1244 and the abutment surface of the beam 1246 to be held in a planar condition.

In the illustrated embodiment, each of plurality of projections 1242A, 1242B, 1244 surrounding each orifice $O_{R1}$, $O_{R2}$ is provided by a removable lip 1240 which at least partially surround the orifice $O_{R1}$, $O_{R2}$. In this way the projections 1242A, 1242B, 1244 and lip can be removed for maintenance or changed to accommodate a different blank 10; 110; 210; 410; 510; 610; 710. In other embodiments, it will be appreciated that the projections 1242A, 1242B, 1244 could be integral with the applicator plate 1212. The beam 1246 may be similarly arranged to be removable or integral with the applicator plate 1212. The projections 1242A, 1242B, 1244 may be arcuate in shape to complement the perimeter of the article receiving orifices $O_{R1}$, $O_{R2}$.

The applicator 1210 is shown in engagement with a blank 10; 110; 210; 410; 510; 610; 710 in FIGS. 19A to 20C, where it can be seen in FIG. 20A that the suction cups 1248 engage an upper surface of the blank 10; 110; 210; 410; 510; 610; 710. The beam 1246 and end projections 1244 abut the upper surface of the blank 10; 110; 210; 410; 510; 610; 710 and maintain the blank 10; 110; 210; 410; 510; 610; 710 in a flat or planar condition. The pairs of opposed abutment surfaces 1224A, 1224B provided by the opposing projections 1242A, 1242B are spaced apart from the upper surface of the blank 10; 110; 210; 410; 510; 610; 710 in an initial state; and more specifically, the first and second abutment surfaces 1224A, 1224B are spaced apart from the upper surface of the blank 10; 110; 210; 410; 510; 610; 710 by a different distance.

In the illustrated example, the first abutment surface 1224A about the first article receiving orifice $O_{R1}$ is provided on an opposite side of the applicator plate 1212 to the first abutment surface 1224A about the second article receiving orifice $O_{R2}$. Similarly, the second abutment surface 1224B about the first article receiving orifice $O_{R1}$ is provided on an opposite side of the applicator plate 1212 to the second abutment surface 1224B about the second article receiving orifice $O_{R2}$. In this way the lips 1240 having the same configuration can be mounted to both ends of the applicator plate 1212. In other embodiments a pair of lips 1240 may be provided, the second lip 1240 being a mirror image of the first lip 1240 such that the first abutment surfaces 1224A of the first and second lip 1240 are disposed on the same side of the article receiving orifices $O_{R1}$, $O_{R2}$, and are disposed on the same side of the applicator plate 1212, and both of the second abutment surfaces 1224B of the first and second lip 1240 are disposed on the opposing side of the applicator plate 1212.

Figure 23:
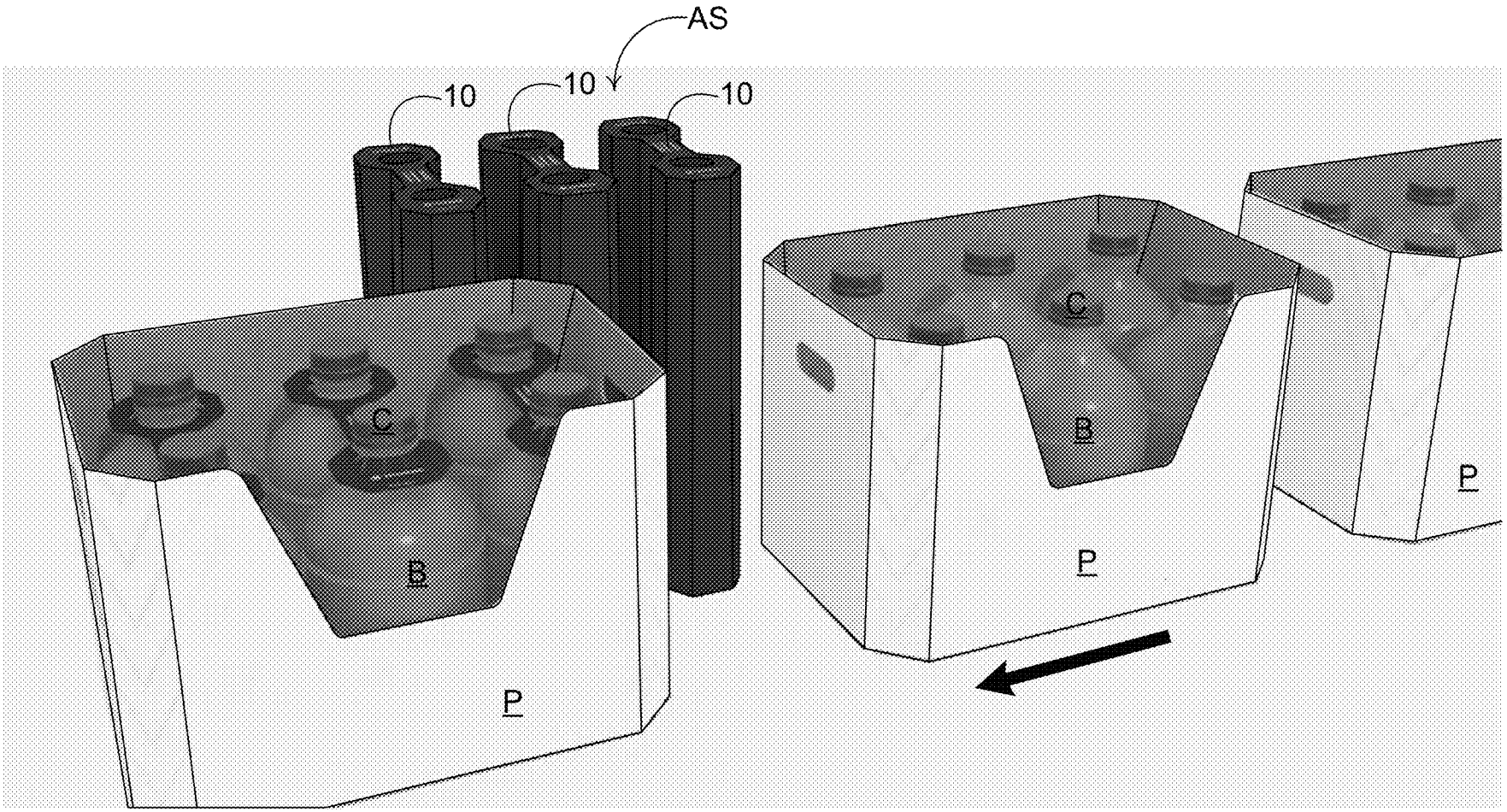
FIG. 23 shows a perspective view from below of a stream of packages loaded with articles passing an application station.

FIG. 23 shows a stream of packages P, each package P is loaded with a plurality of articles B, and in the illustrated example six articles B are provided in a 2×3 matrix or array arrangement. The packages P take the form of an open top container or crate, but may be in any form or arrangement. The packages P pass an applicator station AS. The applicator station AS comprises a plurality of stacks of article blanks 10; specifically, but not limited to, three stack stacks of article blanks 10 or six stacks of article blanks 10, though any number of stacks may be employed. In the illustrated example, three article blanks 10 are applied simultaneously to three pairs of articles B within each package P, though in other examples, a corresponding number of article blanks 10 or a single article blank 10 may be applied to a corresponding number of pairs of articles B. The open upper end of the container is configured to receive the applicator 1310 as shown in FIGS. 24 and 25.

Figure 24:
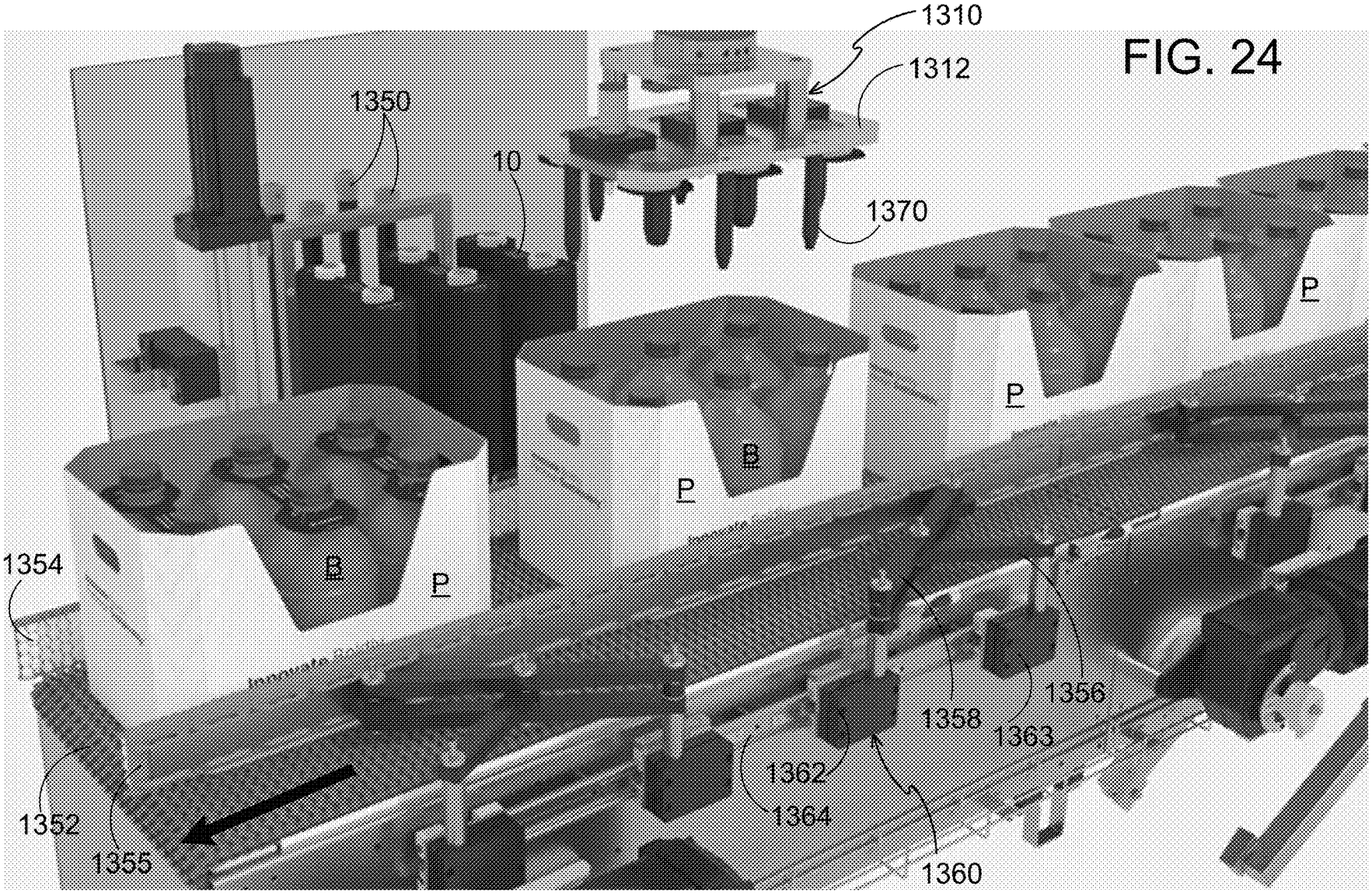
FIG. 24 shows perspective view of a portion of a packaging machine comprising an application station for applying blanks, according to various examples, to articles employing an application apparatus according to embodiments of the present disclosure.
Figure 25:
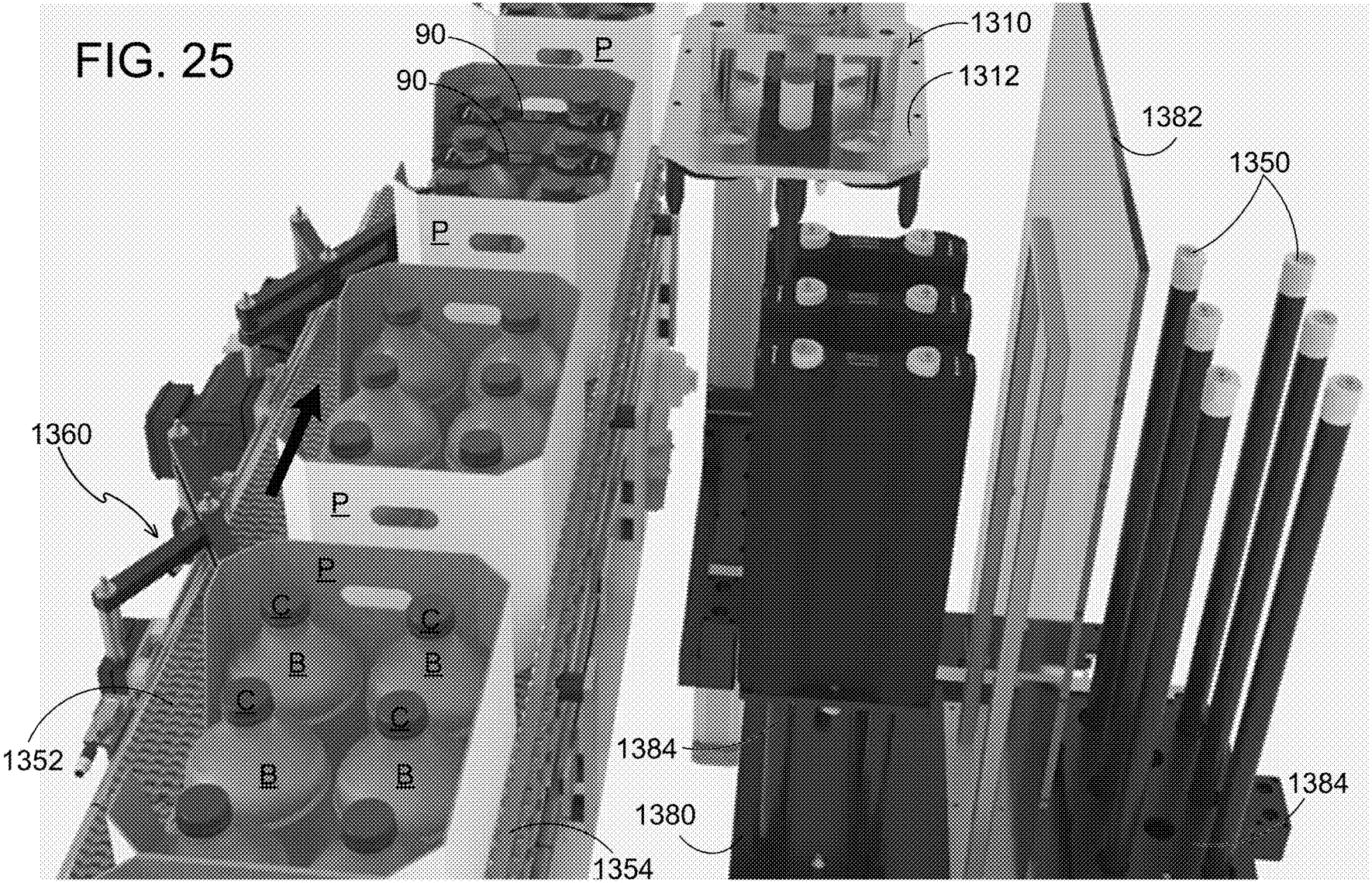
FIG. 25 shows an alternative perspective view of the portion of a packaging machine shown in FIG. 24.

FIG. 24 shows a portion of a packaging machine including the applicator station. The packaging machine comprises a conveyor 1352 for transferring unclipped article packages P to the applicator station and clipped article packages P (i.e., packages P to the articles B of which top-engaging article carriers or clips 90 have been applied) away from the applicator station. The packages P may be disposed between a pair of guide rails 1354, 1355. At least one of the pair of guide rails 1354, 1355 may be adjustable to accommodate packages P of different sizes. An adjustable guide rail 1355 is moveable transversely of the conveyor 1352. The adjustable guide rail 1355 is mounted to the conveyor 1352 by one or more adjustment devices 1360. Each adjustment device 1360 comprises a first arm 1358 pivotally mounted at a first end to the adjustable guide rail 1355. The first arm 1358 is pivotally mounted at a first end to a first carriage 1362. A first end of a second arm 1356 is pivotally mounted to the first arm 1358 at a location disposed between the first and second ends of the first arm 1358. A second end of the second arm 1356 is pivotally mounted to a second carriage 1363. Each of the first and second carriages 1362, 1363 is mounted to a rail 1364 fixed to the conveyor 1352. At least one of the first and second carriages 1362, 1363 is slidably mounted to the rail 1364. In this way the first and second carriages 1362, 1363 can slide or be moved along the rail 1364 to be closer to, or further apart from, each other. Moving the first and second carriages 1362, 1363 towards each other has the effect of pushing the adjustable guide rail 1355 away from the carriages 1362, 1363 towards the other guide rail 1354 reducing the space therebetween. Moving the first and second carriages 1362, 1363 away from each other has the effect of pulling the adjustable guide rail 1355 towards the carriages 1362, 1363 away from the other guide rail 1354 increasing the space therebetween the guide rails 1354, 1355.

An overhead conveyor (not shown) is arranged to move an applicator 1310 transversely of the conveyor 1352 and in upstream and downstream directions relative to the conveyor 1352. The applicator 1310 comprises an applicator plate 1312 having a plurality of article receiving orifices similar to those of the previous embodiments. The applicator plate 1312 comprises a plurality of projections (not shown) disposed at least partially about each article receiving orifice. Suction cups (not shown) are provided to engage or pick up blanks 10 from the hopper. Each blank 10 engaged may be engaged by a pair of suction cups and is brought into engagement with one or more abutments (not shown) projecting from the lower surface of the applicator plate 1312 to maintain the blanks in a planar condition during transfer between the hopper and the conveyor 1352.

The applicator 1310 can pick up or grip three blanks 10, simultaneously, from a hopper disposed adjacent to the conveyor 1352 and place them upon the articles B within a package P whilst the packages P are moving downstream upon the conveyor 1352. The overhead conveyor moves the applicator 1310 in a downstream direction to match the speed of the packages P upon the conveyor 1352. The overhead conveyor moves the applicator 1310 in an upstream direction to return to the hopper.

The applicator 1310 may comprises article engaging fingers 1370 for aligning the articles B with respect to the blanks 10 and/or for stabilising the articles B whilst the blanks 10 are applied.

The hopper comprises pairs of posts 1350 for holding a stack of blanks 10, best shown in FIG. 25. The hopper illustrated comprises a first group of three pairs of posts 1350 configured to hold three stacks of blanks 10 side by side and a second group of three pairs of posts 1350 configured to hold three further stacks of blanks 10 side by side. In the illustrated embodiment the first group of three pairs of posts 1350 is disposed in closer proximity to the conveyor 1352 than the second group of three pairs of posts 1350. The first group of three pairs of posts 1350 is loaded with stacks of blanks 10 whilst the second group of three pairs of posts 1350 are vacant or unloaded. A divider 1382 may separate the first group of posts 1350 from the second group of posts 1350.

The hopper is arranged such that the applicator 1310 picks up three blanks 10 simultaneously from the group of posts 1350 disposed in closest proximity to the conveyor 1352. The first and second groups of posts 1350 are mounted upon a turntable 1380 such that the position of the first and second groups of posts 1350 are interchangeable. When one of the first and second groups of posts 1350 is empty the turntable 1380 may be rotated through 180° to bring a loaded group of posts 1350 into an operative position adjacent the conveyor 1352. The vacant or empty group of posts 1350 is rotated into a holding position in which the pairs of posts 1350 can be reloaded with blanks 10 and await consumption of the blanks 10 mounted to the group of posts 1350 in the operative position.

The hopper comprises a pair of mounting plates 1384, the mounting plates 1384 elevate or support blanks 10 such that the uppermost blank 10 in each stack is disposed proximate the upper end of the pairs of posts 1350 such that the applicator 1310 can engage said banks 10. A single mounting plate 1384 is provided for each of the first and second groups of posts 1350; simultaneously supporting all the three stacks of blanks 10. The mounting plates 1384 are moveable upwardly with respect to the posts 1350 as the blanks 10 are removed from the upper end of the stacks. The mounting plates 1384 can be moved downwardly to allow the pairs of posts 1350 to receive stacks of blanks 10.

The present disclosure provides a packaging system including a packaging apparatus 1000; 1110; 1210; 1310; a packaging machine having an application station AS, article carriers 90, and a method of applying blanks 10; 110; 210; 410; 510; 610; 710 to articles B to form the article carriers 90.

The method of applying blanks 10; 110; 210; 410; 510; 610; 710 comprises asynchronously applying force or pressure, first to one side or longitudinal edge and then then the other side or longitudinal edge of the article carrier 90. The apparatus 1000 is arranged to bring a first abutment surface 1024A into contact with a first side of the article carrier 90 in a region adjacent to an article retention structure RT provided by the article carrier 90, and the subsequently bring a second abutment surface 1024B into contact with a second side of the article carrier 90 in a region adjacent to an article retention structure RT provided by the article carrier 90.

Each of the first and second abutment surfaces 1024A, 1024B is provided by a limb extending from, or mounted to, an applicator plate 1012, 1112. The limbs may have unequal length or height. The limbs are spaced apart from each other sufficient that an upper portion of an article B can be disposed therebetween. The limbs may be provided by an annular wall 1022 having an internal diameter sufficiently larger to accommodate the upper portion of the article B. A gap or void is provided between the limbs such that engaging teeth 40, 42, 44 provided on the article carrier 90 can be folded or displaced outwardly without encumbrance. The gap or void may be provided by a recess in the end of the annular wall between the first and second abutment surfaces 1024A, 1024B so as to define a saddle 1030.

The present disclosure also provides a method of applying blanks 10; 110; 210; 410; 510; 610; 710 comprising displacing a first side or longitudinal edge of one or more primary panels 12, 14, 16; 112; 212, 214; 412, 414, 416; 512, 514, 516; 612, 614, 616; 712, 714 of the blank 10; 110; 210; 410; 510; 610; 710 a greater extent than the other, opposing, side or longitudinal edge of said one or more primary panels 12, 14, 16; 112; 212, 214; 412, 414, 416; 512, 514, 516; 612, 614, 616; 712, 714 whilst engaging the blank 10; 110; 210; 410; 510; 610; 710 with one or more articles B.

The present disclosure also provides an article carrier 90 comprising at least one primary panel 12, 14, 16; 112; 212, 214; 412, 414, 416; 512, 514, 516; 612, 614, 616; 712, 714 forming a handle structure. The at least one primary panel 12, 14, 16; 112; 212, 214; 412, 414, 416; 512, 514, 516; 612, 614, 616; 712, 714 comprises at least one, at least two, or more article retention structures RT for engaging an article so as to provide a top gripping article carrier 90.

The at least one article retention structure RT comprises a receiving opening having or defined by a boundary including a first edge E1 and second opposing edge E2. The second edge E2 is defined by a series of distal or engaging ends of the engaging teeth 40, 42, 44; 140, 142, 144; 240, 242, 244; 440, 442, 444; 540, 542, 544; 640, 642, 644; 740, 742, 744.

The first edge E1 may be arranged to be closer to the handle H than the second edge E2. Either one of the first and second edges E1, E2 may be curved concavely as viewed from the location of the other. The first edge E1 may be curved such that the centre of curvature $C_e$1 of the first edge E1 is located closer to the second edge E2 than to the first edge E1. The boundary further includes a pair of third and fourth opposing edges E3, E4 which continuously connect the first and second edges E1, E2 such that each of the third and fourth edges E3, E4 provides a smooth transition between the first and second edges E1, E2. Either one of the third and fourth edges E3, E4 may be curved concavely as viewed from the location of the other.

The radius of curvature r1 of the first edge E1 may be less than the radius of curvature r2 of the second edge E2.

The third and fourth opposing edges E3, E4 each continuously connects the first and second edges E1, E2. The third and fourth edges E3, E4 are spaced apart such that the maximum distance therebetween is less than the lateral dimension (e.g., the diameter) of the radially protruding portion (e.g., a bottle neck flange or a bottle cap) of the associated article such as a bottle.

The present disclosure also provides an article carrier 90 comprising release device, the release device may comprise a pull tab T1, T2, T3. Optionally, the release device comprises a cut C3, C4, C6; the cut C3, C4, C6 may be arcuate or curved. The cut C3, C4, C6 is disposed between the pull tab T1, T2, T3 and a top-receiving opening of the at least one article retention structure RT. The cut C3, C4, C6 is disposed is disposed on a first or outer side of the top-receiving opening.

The present disclosure also provides an article carrier 90 comprising a relief device, the relief device comprises a relief cut C1, C2, C5; the relief cut C1, C2, C5 may be arcuate or curved. The relief cut C1, C2, C5 is disposed between the handle H and a top-receiving opening of the at least one article retention structure RT. The relief cut C1, C2, C5 is disposed on a second or inner side of the top-receiving opening. The second side of the top-receiving opening opposes the first side.

The present disclosure also provides an article carrier 90 comprising a top engaging feature or article retention structure RT comprising a top-receiving opening and a series of engaging tabs 40, 42, 44; 140, 142, 144; 240, 242, 244; 440, 442, 444; 540, 542, 544; 640, 642, 644; 740, 742, 744 disposed along an outer section E2 of the perimeter of the opening. The outer section generally opposes an inner section adjacent to the handle H or intermediate portion of the primary panel 12, 14, 16; 112; 212, 214; 412, 414, 416; 512, 514, 516; 612, 614, 616; 712, 714. The radius of curvature r1 of the inner section E1 of the opening perimeter is less than the radius of the curvature r2 defined by distal ends of the engaging tabs 40, 42, 44; 140, 142, 144; 240, 242, 244; 440, 442, 444; 540, 542, 544; 640, 642, 644; 740, 742, 744. The distal ends of the engaging tabs 40, 42, 44; 140, 142, 144; 240, 242, 244; 440, 442, 444; 540, 542, 544; 640, 642, 644; 740, 742, 744 provide engaging edges for engaging with an article B.

The present disclosure also provides a top engaging carrier 90 comprising a pair of engaging portions and a handle portion H bridging between the engaging portions. The carrier 90 is formed from at least two layers of sheet material in face contacting arrangement. The at least two layers of sheet material may be secured together for example using glue or other adhesive treatment or mechanical fasteners. The mechanical fasteners may be provided by article retention structure RT in each of the at least two layers of sheet material and disposed in vertical registry with each other; the at least two layers of sheet material being secured together when an article B is received in the article retention structure RT in each of the at least two layers of sheet material. The at least two layers of sheet material may include a first layer 14 and a second layer 12. The first layer 14 may be greater in longitudinal dimension than the second layer 12 to provide an accessing tab at an end of the first layer 14 projecting outwards beyond the adjacent end of the second layer 12.

The present disclosure also provides a top engaging feature or article retention structure RT comprising a top-receiving opening and a series of engaging tabs 40, 42, 44; 140, 142, 144; 240, 242, 244; 440, 442, 444; 540, 542, 544; 640, 642, 644; 740, 742, 744 disposed along an outer section of the opening perimeter. The series of engaging tabs 40, 42, 44; 140, 142, 144; 240, 242, 244; 440, 442, 444; 540, 542, 544; 640, 642, 644; 740, 742, 744 includes a pair of end tabs 40; 140; 240; 440; 540; 640; 740 at each end of the series. Each of the end tabs 40; 140; 240; 440; 540; 640; 740 is defined in part by a tear stopper, the tear stopper may take the form of a recess or a "J" shaped cut line.

The present disclosure also provides a top engaging feature or article retention structure RT comprising a top-receiving opening and a series of engaging tabs 40, 42, 44; 140, 142, 144; 240, 242, 244; 440, 442, 444; 540, 542, 544; 640, 642, 644; 740, 742, 744 disposed along an outer section of the opening perimeter. At least one of medial tabs 44 is adjoined at its proximal end by an accessing feature which may be accessed by a user to disengage the top engaging feature from the associated article B.

The present disclosure also provides a top engaging feature or article retention structure RT comprising a top-receiving opening and a series of engaging tabs 40, 42, 44; 140, 142, 144; 240, 242, 244; 440, 442, 444; 540, 542, 544; 640, 642, 644; 740, 742, 744. A first one of the series of engaging tabs 40, 42, 44; 140, 142, 144; 240, 242, 244; 440, 442, 444; 540, 542, 544; 640, 642, 644; 740, 742, 744 is hinged to the primary panel 12, 14, 16; 112; 212, 214; 412, 414, 416; 512, 514, 516; 612, 614, 616; 712, 714 by a first fold line 41, a second one of the series of engaging tabs 40, 42, 44; 140, 142, 144; 240, 242, 244 is hinged to the primary panel 12, 14, 16; 112; 212, 214; 412, 414, 416; 512, 514, 516; 612, 614, 616; 712, 714 by a second fold line 43. The first and second fold lines 41, 43 define therebetween an obtuse angle θ which optionally may be between 115° and 135° and further optionally may be about 125°. The first fold line 41 optionally defines an angle of about 20° with respect to a first notional line x-x while the second fold line 43 optionally defines an angle of about 15° with respect to a second notional line y-y. First notional line x-x is parallel to the longitudinal axis of the primary panel 12, 14, 16; 112; 212, 214; 412, 414, 416; 512, 514, 516; 612, 614, 616; 712, 714, and second notional line y-y is perpendicular to first notional line x-x.

It can be appreciated that various changes may be made within the scope of the present invention. For example, the size and shape of the panels and apertures may be adjusted to accommodate articles of differing size or shape.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed, a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half-moon shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, any combination thereof, and the like. The elements can be dimensioned and arranged to provide the desired functionality. For example, a line of perforations can be dimensioned or designed with degrees of weakness to define a fold line or a severance line or both. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A component for an applicator device comprising:

a first abutment projection having a first end and a second, opposing, end disposed a first distance from the first end, the first end providing a first abutment surface, and a second abutment projection having a first end and a second, opposing, end disposed a second distance from the first end, the first end providing a second abutment surface, wherein the first abutment projection is spaced apart from the second abutment projection by at least an article receiving orifice, and wherein the second distance is less than the first distance, the component further comprising at least one third abutment projection having a first end and a second, opposing, end disposed a third distance from the first end, the first end providing a third abutment surface, and wherein the first and second distance are each less than the third distance.

2. A component according to claim 1, wherein the component further comprises a pair of third abutment projections.

3. A component according to claim 1, wherein the component further comprises at least one suction cup for engaging an article.

4. A component according to claim 2, wherein the component comprises at least a pair of suction cups, and wherein one of the pair of third abutment projections is disposed between the pair of suction cups.

5. A component according to claim 2, wherein the another one of the pair of third abutment projections is disposed adjacent to the first and second abutment projection, such that the first and second abutment projections and said another third abutment projection at least partially surround the article receiving orifice.

6. An apparatus, which has the component of claim 1, for forming a package, the apparatus comprising an applicator comprising an applicator plate for engaging an article carrier, the applicator plate comprising a first article receiving orifice and the component of claim 1 mounted thereto at least partially about the first article receiving orifice, wherein the first abutment projection is spaced apart from the second abutment projection by at least the first article receiving orifice.

7. An apparatus according to claim 6, wherein the applicator plate has a second article receiving orifice and the component of claim 1 mounted thereto at least partially about the second article receiving orifice, wherein the first abutment projection is spaced apart from the second abutment projection by at least the second article receiving orifice.

8. An apparatus according to claim 7, wherein the applicator plate comprises a pair of suction cups mounted thereto.

9. An apparatus according to claim 8, wherein the applicator plate comprises a further third abutment projection mounted to the applicator plate between the pair of suction cups.

10. An apparatus for forming a package, the apparatus comprising an applicator comprising an applicator plate for engaging an article carrier, the applicator plate comprising:

a first article receiving orifice;

a major abutment projection having a first end and a second, opposing, end disposed a first distance from the first end, the first end providing a first abutment surface, and a minor abutment projection having a first end and a second, opposing, end disposed a second distance from the first end, the first end providing a second abutment surface, wherein the major abutment projection is spaced apart from the minor abutment projection by at least the first article receiving orifice, and wherein the second distance is less than the first distance, the applicator plate further comprising at least one support abutment projection comprising a first end and a second, opposing, end disposed a third distance from the first end, the first end providing a third abutment surface, and wherein the first and second distance are less than the third distance.

11. An apparatus according to claim 10, wherein the applicator plate comprises a second article receiving orifice and a second major abutment projection having a first end and a second, opposing, end disposed a first distance from the first end, the first end providing a second first abutment surface, and a second minor abutment projection having a first end and a second, opposing, end disposed a second distance from the first end, the first end providing a second abutment surface, wherein the second major abutment projection is spaced apart from the second minor abutment projection by at least the second article receiving orifice, and wherein the second distance is less than the first distance, the applicator plate further comprising at least one second support abutment projection having a first end and a second, opposing, end disposed a third distance from the first end, the first end providing a third abutment surface and wherein the first and second distance are each less than the third distance.

* * * * *